US009146492B2

(12) United States Patent
Suzuki

(10) Patent No.: US 9,146,492 B2
(45) Date of Patent: Sep. 29, 2015

(54) ELECTROPHOTOGRAPHIC IMAGE FORMING APPARATUS

(71) Applicant: CANON KABUSHIKI KAISHA, Tokyo (JP)

(72) Inventor: Tetsuji Suzuki, Fujisawa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/227,262

(22) Filed: Mar. 27, 2014

(65) Prior Publication Data

US 2014/0210929 A1 Jul. 31, 2014

Related U.S. Application Data

(63) Continuation of application No. 13/383,245, filed as application No. PCT/JP2010/051073 on Jan. 21, 2010, now Pat. No. 8,737,871.

(30) Foreign Application Priority Data

Aug. 27, 2009 (JP) ..... 2009-196714
Dec. 22, 2009 (JP) ..... 2009-290041

(51) Int. Cl.
*G03G 15/00* (2006.01)
*G03G 15/04* (2006.01)
(Continued)

(52) U.S. Cl.
CPC . *G03G 15/04* (2013.01); *B41J 2/44* (2013.01); *G03G 21/1666* (2013.01);
(Continued)

(58) Field of Classification Search
CPC ..... G03G 15/2053; G03G 2215/2035; G03G 15/2039; G03G 15/2064; G03G 15/6502; G03G 15/6544; G03G 2215/00426; G03G 2215/00544; G03G 2215/00848; G03G 2215/00936; G03G 2221/1675; G03G 15/602
See application file for complete search history.

(56) References Cited

U.S. PATENT DOCUMENTS 4,937,624 A 6/1990 Kohtani et al.
4,937,626 A 6/1990 Kohtani et al.
(Continued)

FOREIGN PATENT DOCUMENTS

CN 101377637 A 3/2009
JP 2007-140392 A 6/2007
(Continued)

OTHER PUBLICATIONS

International Search Report and Written Opinion of the International Searching Authority mailed on Apr. 19, 2010, with a Notification of Transmittal of the International Search Report and the Written Opinion of the International Searching Authority, or the Declaration in International Application No. PCT/JP2010/051073.
(Continued)

*Primary Examiner* — Roy Y Yi
(74) *Attorney, Agent, or Firm* — Fitzpatrick, Cella, Harper & Scinto

(57) ABSTRACT

An electrophotographic image forming apparatus (100) including: a cartridge tray (5) movable between an inside position (IP) and an outside position (OP) of a main body of the apparatus with supporting a cartridge (8); a light emitting member (9) having a plurality of light emitting elements for emitting light to expose a photosensitive member in accordance with image information; a support (7) that supports the light emitting member so that the light emitting member assumes between an exposure position (LP) at which the photosensitive member is exposed with the light emitting element and a retracted position (RP) retracted from the exposure position; and an interlocking device (130, 170) that moves the support between the exposure position and the retracted position in association with movement of the tray toward the outside and inside positions.

58 Claims, 12 Drawing Sheets

(51) Int. Cl.
*G03G 21/18* (2006.01)
*G03G 21/16* (2006.01)
*B41J 2/44* (2006.01)

(52) U.S. Cl.
CPC ..... *G03G 21/1821* (2013.01); *G03G 21/1853* (2013.01); *G03G 2215/0402* (2013.01); *G03G 2221/1636* (2013.01); *G03G 2221/1684* (2013.01)

(56) References Cited

U.S. PATENT DOCUMENTS

| | | | | |
|---|---|---|---|---|
| 5,600,423 | A | 2/1997 | Miyashiro et al. | |
| 6,091,913 | A | 7/2000 | Suzuki et al. | |
| 6,411,791 | B2 | 6/2002 | Nittani et al. | |
| 6,654,583 | B2 | 11/2003 | Suzuki et al. | |
| 6,915,094 | B2 | 7/2005 | Tsuruya et al. | |
| 7,010,254 | B2 | 3/2006 | Takeuchi et al. | |
| 7,020,419 | B2 | 3/2006 | Tsuruya et al. | |
| 7,035,562 | B1 | 4/2006 | Suzuki et al. | |
| 7,127,200 | B2 | 10/2006 | Nakamura et al. | |
| 7,587,149 | B2 | 9/2009 | Suzuki et al. | |
| 7,649,543 | B2 | 1/2010 | Tanabe | |
| 7,656,421 | B2 | 2/2010 | Itabashi | |
| 7,742,710 | B2 | 6/2010 | Miura et al. | |
| 7,860,437 | B2 | 12/2010 | Kakuta et al. | |
| 8,019,240 | B2 | 9/2011 | Kakuta et al. | |
| 8,078,085 | B2 | 12/2011 | Okabe | |
| 8,452,213 | B2 | 5/2013 | Okabe | |
| 8,737,871 | B2 * | 5/2014 | Suzuki | 399/110 |
| 2008/0219696 | A1 | 9/2008 | Itabashi | |
| 2008/0219697 | A1 | 9/2008 | Itabashi | |
| 2008/0259364 | A1 | 10/2008 | Morita et al. | |
| 2008/0304860 | A1 | 12/2008 | Hisada | |
| 2009/0058978 | A1 | 3/2009 | Itabashi | |
| 2009/0129812 | A1 | 5/2009 | Kawanami et al. | |
| 2009/0190953 | A1 | 7/2009 | Okabe | |
| 2009/0202272 | A1 * | 8/2009 | Nakashima | 399/117 |
| 2011/0076062 | A1 | 3/2011 | Kakuta et al. | |
| 2011/0299883 | A1 | 12/2011 | Suzuki | |

FOREIGN PATENT DOCUMENTS

| | | | |
|---|---|---|---|
| JP | 2008-221587 | A | 9/2008 |
| JP | 2009-122391 | A | 6/2009 |
| JP | 2009-128506 | A | 6/2009 |
| JP | 2009-175416 | A | 8/2009 |
| JP | 2009-265442 | A | 11/2009 |

OTHER PUBLICATIONS

Notification Concerning Transmittal of International Preliminary Report on Patentability mailed Mar. 8, 2012, forwarding an International Preliminary Report on Patentability issued Feb. 28, 2012, in International Application No. PCT/JP2010/051073.
Notification of the First Office Action dated Feb. 16, 2013, in Chinese Patent Application No. 201080037228.3.
Korean Office Action dated Aug. 12, 2013, in related Korean Patent Application No. 10-2012-7007027.
Chinese Office Action dated Aug. 12, 2013, in related Chinese Patent Application No. 201080037228.8 (with English translation).

* cited by examiner

ELECTROPHOTOGRAPHIC IMAGE FORMING APPARATUS

This application is a continuation of application Ser. No. 13/383,245, filed on Jan. 10, 2012, which is a National Stage Entry of International Patent Application No. PCT/JP2010/051073, filed on Jan. 21, 2010.

TECHNICAL FIELD

The present invention relates to an electrophotographic image forming apparatus that forms an image on a recording medium in a state in which a cartridge is detachably mounted to an apparatus main body.

In this case, the electrophotographic image forming apparatus (hereinafter, referred to as an image forming apparatus) is a type in which an image is formed on the recording medium by using an electrophotographic image forming process. As the image forming apparatus, for example, there are given an electrophotographic copying machine, an electrophotographic printer (for example, a color LED printer), a facsimile apparatus, and a word processor. Further, as the image forming apparatus, both of a black and white type and a color type are encompassed therein. Further, a cartridge is, for example, a process cartridge or a developing cartridge, which is detachably mounted to a main body of the electrophotographic image forming apparatus to contribute to an image forming process for forming an image on the recording medium. In this case, the process cartridge is constituted as a cartridge into which at least one of a charging means, a developing means, and a cleaning means, which serve as a process means, is incorporated integrally with an electrophotographic photosensitive drum, which cartridge is detachably mounted to the main body of the electrophotographic image forming apparatus. Therefore, the process cartridge includes one which is constituted as a cartridge into which the developing means serving as the process means is incorporated integrally with the electrophotographic photosensitive drum, which cartridge is detachably mounted to the main body of the electrophotographic image forming apparatus. Further, the process cartridge includes one which is constituted as a cartridge into which the charging means, the developing means, or the cleaning means, which serve as the process means, are incorporated integrally with the electrophotographic photosensitive drum, which cartridge is detachably mounted to the main body. Note that, the process cartridge, which incorporates the electrophotographic photosensitive drum and the developing means integrally with each other, is referred to as a so-called integral type. Besides, the process cartridge which includes the electrophotographic photosensitive drum and the process means other than the developing means formed integrally with each other is referred to as a so-called separate type.

In this case, in the process cartridge, the user him/herself may perform mounting and detaching operation with respect to the image forming apparatus main body. Therefore, the user may easily perform maintenance for the apparatus main body. Note that, the process means acts on the electrophotographic photosensitive drum.

Further, the developing cartridge includes a developing roller, contains developer (toner) which is used for developing an electrostatic latent image formed on the electrophotographic photosensitive drum by the developing roller, and is detachably mounted to the main body. Note that, in a case of the developing cartridge, the electrophotographic photosensitive drum is attached to the apparatus main body or a cartridge-supporting member described later. Alternatively, the electrophotographic photosensitive drum is provided to the so-called separate type process cartridge (in this case, the process cartridge does not include the developing means). Note that, also in the developing cartridge, the user him/herself may perform mounting and detaching operation with respect to the image forming apparatus main body. Therefore, the user may easily perform maintenance for the apparatus main body.

Therefore, as the cartridge, the so-called integral type or the so-called separate type process cartridge is included therein. Further, there is included as the cartridge a case in which the so-called separate type process cartridge and the developing cartridge are used in a pair. Further, as the cartridge, the electrophotographic photosensitive drum is securely attached to the apparatus main body or the cartridge supporting member described later. Then, there is included a case in which the developing cartridge is capable of acting on the electrophotographic photosensitive drum, and is detachably mounted to the cartridge supporting member. Further, the recording medium is a type on which an image is formed by the electrophotographic image forming apparatus, and includes, for example, paper and an OHP sheet.

BACKGROUND ART

Hitherto, there is known an image forming apparatus, which has a cartridge support for detachably supporting a plurality of cartridges, the cartridge support being provided so as to be movable with respect to an apparatus main body (U.S. Patent Application Publication No. 2008/219696). In this structure, the cartridge support is pulled out from the apparatus main body together with an LED support from a regular position to a replacement position. Then, the LED support is manually moved from a regular position to a replacement position. With this, the cartridge support is exposed. Therefore, the cartridge supported by the cartridge support may be replaced.

In the conventional image forming apparatus described above, when replacing the cartridge, the user is required to, in addition to an operation of pulling out the cartridge support from the apparatus main body, manually rotate the LED support to the retracted position in a state in which the support is pulled out.

DISCLOSURE OF THE INVENTION

It is an object of the present invention to provide an electrophotographic image forming apparatus with improved operability for operating a light emitting member support.

It is another object of the present invention to provide an electrophotographic image forming apparatus capable of automatically moving a light emitting member support from an exposure position to a retracted position in association with a movement of a cartridge supporting member toward an outside position.

It is still another object of the present invention to provide an electrophotographic image forming apparatus capable of automatically moving a light emitting member support from a retracted position to an exposure position in association with a movement of a cartridge supporting member toward an inside position.

It is further another object of the present invention to provide an electrophotographic image forming apparatus capable of automatically moving a light emitting member support from an exposure position to a retracted position in association with a movement of a cartridge supporting member toward an outside position, and capable of automatically moving the light emitting member support from the retracted position to the exposure position in association with the movement of the cartridge supporting member toward the inside position.

In order to attain the above-mentioned objects of the present invention, the present invention provides an electrophotographic image forming apparatus that forms an image on a recording medium in a state in which a cartridge is detachably mounted to an apparatus main body of the electrophotographic image forming apparatus, including:

a cartridge supporting member, which is movable between an inside position located inside the apparatus main body and an outside position located outside the apparatus main body, in a state of supporting the cartridges;

a light emitting member having a plurality of light emitting elements provided side-by-side in a longitudinal direction of an electrophotographic photosensitive drum in a state in which the cartridge supporting member supporting the cartridge locates at the inside position to emit light for exposing the electrophotographic photosensitive drum in accordance with image information;

a light emitting member support that supports the light emitting member so that the light emitting member can assume between an exposure position at which the plurality of light emitting elements emit light to expose the electrophotographic photosensitive drum and a retracted position retracted from the exposure position; and interlocking means that moves the light emitting member support from the exposure position to the retracted position in association with a movement of the cartridge supporting member toward the outside position, and moves the light emitting member support from the retracted position to the exposure position in association with a movement of the cartridge supporting member toward the inside position.

Further features of the present invention will become apparent from the following description of exemplary embodiments with reference to the attached drawings.

BEST MODE FOR CARRYING OUT THE INVENTION

Figure 1:
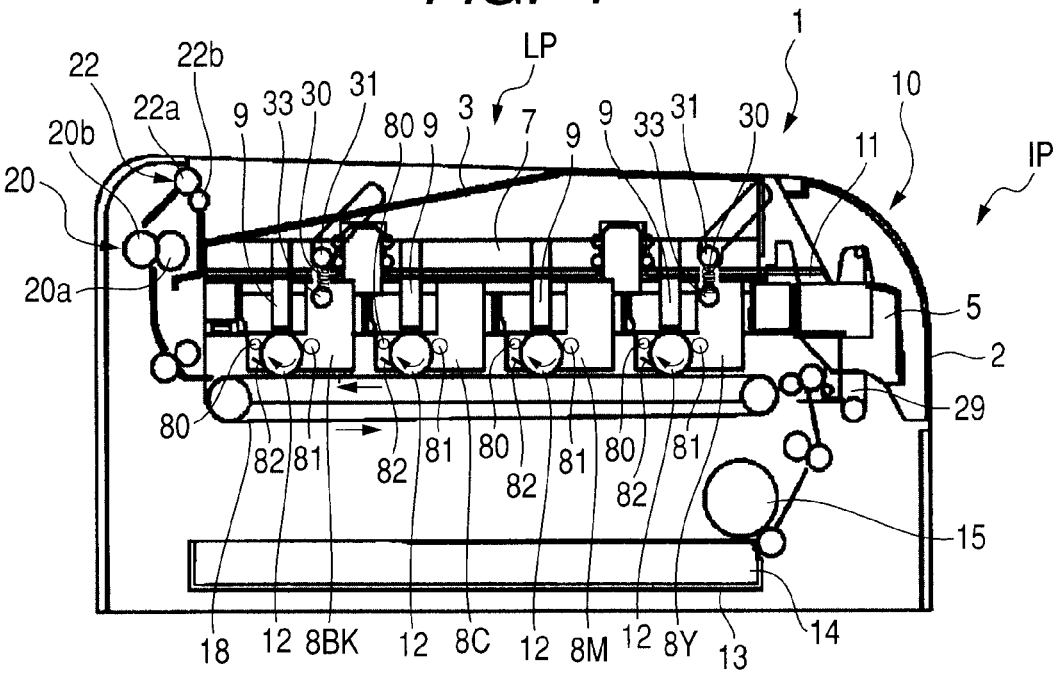
FIG. 1 is a sectional view of an image forming apparatus according to Embodiment 1 of the present invention.

Hereinafter, embodiments of the present invention will be described with reference to the accompanying drawings.

Embodiment 1

An electrophotographic image forming apparatus according to Embodiment 1 of the present invention includes a cartridge supporting member that moves between an inside position and an outside position of an apparatus main body in a state in which the cartridge supporting member supports process cartridges. In association with the movement of the cartridge supporting member toward the outside position, the light emitting member support is moved from an exposure position to a retracted position by interlocking means. In association with the movement of the cartridge supporting member toward the inside position, the light emitting member support is moved from the retracted position to the exposure position by the interlocking means. According to Embodiment 1 of the present invention, the interlocking means 130 (described later) automatically moves, in association with the movement of a tray (a cartridge supporting member) 5 when the user pulls out the tray 5 toward the outside position OP, the light emitting member support 7 from the exposure position LP to the retracted position RP. The interlocking means 130 automatically moves, in association with the movement of the tray 5 when the user pushes in the tray 5 toward the inside position IP, the support 7 from the retracted position RP to the exposure position LP. The retracted position RP is a position at which the support 7 (light emitting members 9) does not interfere with the movement of the tray 5, which is supporting the cartridges 8. Besides, the retracted position RP is a position at which the support 7 (the light emitting members 9) does not collide with the moving tray 5 and the moving cartridges 8, which are moving while being supported by the tray 5.

Referring to FIG. 1 to FIG. 8B, a full color electrophotographic image forming apparatus (hereinafter, referred to as an image forming apparatus) according to Embodiment 1 of the present invention will be described. The image forming apparatus according to Embodiment 1 of the present invention as illustrated in FIG. 1 is a full color LED printer. An image forming apparatus 100 includes light emitting members that emit light in accordance with image information to expose electrophotographic photosensitive drums (hereinafter, referred to as photosensitive drums) 12. Note that, in the embodiments described below, a description will be provided of the full color LED printer by way of example, but the invention is not limited to the full color LED printer. The present invention can be applied to the above-mentioned image forming apparatus. Further, in the embodiments described below, a description will be provided of, by way of example, a process cartridge as a cartridge, but the invention is not limited to the process cartridge. The present invention can be applied to the image forming apparatus, which uses the above-mentioned cartridge.

Description of Image Forming Apparatus

Referring to FIG. 1 to FIG. 4B, the structure of the image forming apparatus 100 will be described. FIG. 1 is a sectional view of the image forming apparatus 100 according to Embodiment 1 of the present invention.

Apparatus Main Body

Figure 2:
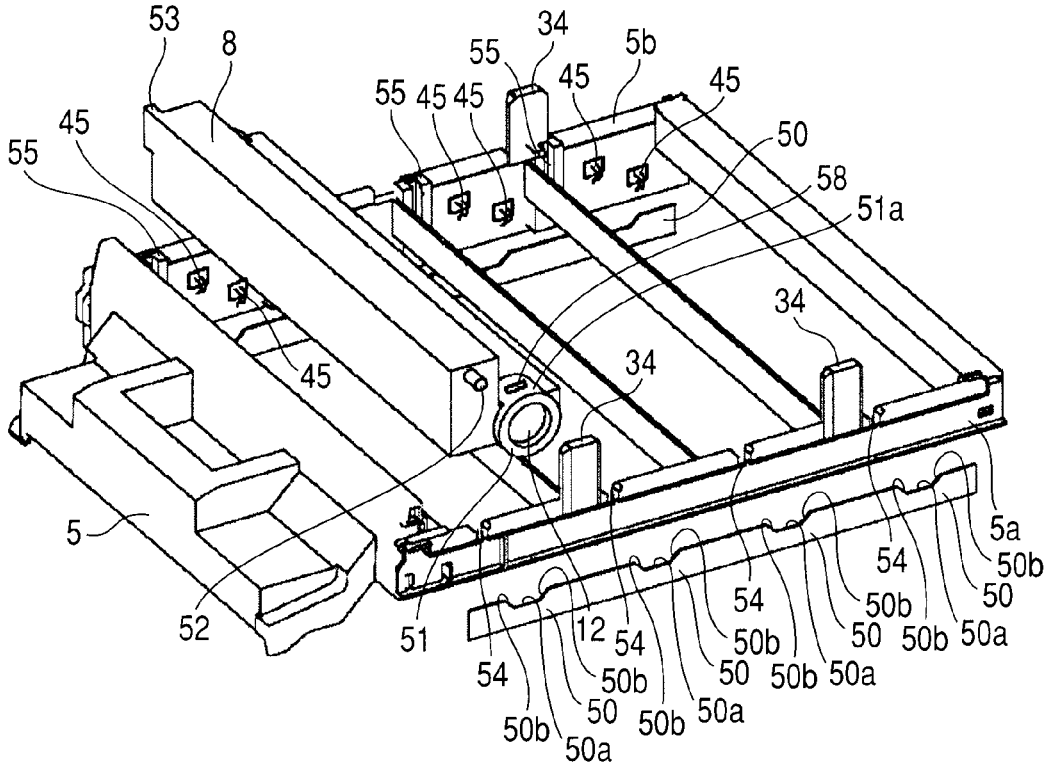
FIG. 2 is a perspective view of a tray according to Embodiment 1 of the present invention.

In the apparatus main body 1 of the image forming apparatus 100, there are provided a sheet feeding tray 13, a feed roller 15, a transfer belt 18, a fixing device 20, a pair of sheet discharging rollers 22, and a discharge tray 3. The tray 13 serves to receive and stack a sheet (recording medium) 14. The fixing device 20 includes a fixing film 20*a* and a pressure roller 20*b*. The roller pair 22 includes a sheet discharging roller 22*a* and the sheet discharging runner 22*b*. The sheet 14, on which an image is formed, is delivered through the roller pair 22 to be stacked on the tray 3. Further, in the main body 1, main body guides 11 are provided (refer to FIG. 4A, FIGS. 5A, 5B, and 5C). The guides 11 support a cartridge tray (a cartridge supporting member) 5 so as to be movable. The tray 5 detachably supports the process cartridges (hereinafter, referred to as cartridge) 8 (8Y, 8M, 8C, and 8BK). In a state in which the tray 5 locates at the inside position IP (FIG. 1) inside the main body, the cartridges 8 are mounted on drum holders (hereinafter, refereed to as mounting portions) 50 (FIG. 2). Note that, in the cartridges 8, drum bearing portions (drum side positioning portions) 51 provided coaxially with the drum 12 are positioned by the mounting portions 50. Note that, the cartridges 8Y contains the developer (hereinafter, referred to as toner) of yellow, and forms a yellow developer image on the photosensitive drum 12. The cartridge 8M contains a magenta developer, and forms a magenta developer image on the photosensitive drum 12. The cartridge 8C contains a cyan developer, and forms a cyan developer image on the photosensitive drum 12. The cartridge 8BK contains a black developer, and forms a black developer image on the photosensitive drum 12. The cartridges 8 each integrally incorporates the photosensitive drum 12, and as the process means, a charging roller (a charging member) 80, a developing roller (a developing member) 81, and a cleaning blade (a cleaning member) 82. The process means acts on the photosensitive drum 12. The charging roller 80 charges the drum 12. The developing roller 81 develops an electrostatic latent image formed on the drum 12 by using the developer (not shown). Besides, the cleaning blade 82 removes the residual developer on the drum 12 after transfer of the image.

Note that, the main body 1 refers to a structure in which the cartridge tray 5 and the cartridges 8 are removed from the image forming apparatus 100.

Cartridge Tray

The tray 5 is supported by the guides 11 with respect to the main body 1, and is provided for a slide movement in a lateral direction (a front-back direction of main body 1) in FIG. 1. The tray 5 detachably supports the cartridges 8. Further, the tray 5 includes intermediate electrical contacts 45 (FIG. 2) to be connected to cartridge side electrical contacts (not shown) included in the cartridges 8. The intermediate electrical contacts 45 electrically connect to main body side electrical contacts (not shown) provided in the main body 1 in a state in which the tray 5 locates at the inside position IP. As illustrated in FIG. 2, the electrical contacts 45 are arranged on a side plate 5*b* on a non-drive side (one end portion side in the longitudinal direction of the cartridge 8) of the tray 5. However, the arrangement of the electrical contacts 45 is not limited thereto. The electrical contacts 45 may be arranged on a side plate 5*a* on a drive side. The tray 5 moves, in a state of detachably supporting the cartridges 8, between the inside position IP inside the main body and the outside position OP outside the main body 1 while passing through the opening portion 10. The guides 11 support the tray 5 so that the tray 5 is movable between the outside position OP and the inside position IP, and also guide the tray 5. When the user pulls out the tray 5 from the main body 1, the tray 5 moves from the inside position IP to the outside position OP. Further, when the user pushes in the tray 5 into the main body 1, the tray 5 moves from the outside position OP to the inside position IP. Here, the inside position IP refers to the position illustrated in FIG. 1, FIG. 5A, and FIG. 6A. Besides, the outside position OP refers to the position illustrated in FIG. 5C, FIG. 6B, and FIGS. 9A and 9B. Note that, the inside position IP refers to a state in which the tray 5 locates inside the opening portion 10 of the main body 1. Besides, the outside position OP refers to a state in which the tray 5 locates outside the opening portion 10. Note that, even in a case where the tray 5 locates at the outside position OP, all the cartridges 8 supported by the tray 5 may not locate outside the opening portion 10. For example, in a pullout direction X (FIG. 6B) of the tray 5, the cartridge 8BK, which locates at the most upstream side, may locates inside the opening portion 10. Even in such cases, the cartridge 8BK, which locates at the most upstream side, locates at a frontforward of the main body 1, it is easy for the user to replace the cartridge 8BK from the opening portion 10. Further, the respective cartridges 8 are supported by the tray 5 in a crossing direction (orthogonal direction) in which the longitudinal directions of the respective cartridges 8 intersect with the movement direction of the tray 5 (pullout direction X and push-in direction Y). The longitudinal direction is the same direction as the longitudinal direction of the photosensitive drum 12 and the longitudinal direction of a developing roller 81. However, the present invention is applicable to a case where the respective cartridges 8 are supported by the tray 5 so that the longitudinal direction of the cartridges 8 is running along (parallel to) to the movement direction of the tray 5.

Cartridge Mounting Portion

FIG. 2 is a perspective view for illustrating a method of positioning the cartridges 8 at the mounting portions 50 in the main body 1. As illustrated in FIG. 2, the mounting portions 50 are formed in the main body 1. The mounting portions 50 are arranged one end side and the other end side in the longitudinal direction of the cartridges 8, which locate at the inside position (in this case, image formation positions at which the cartridges 8 contribute the image formation) IP in the main body 1. In the cartridges 8, the drum bearing portions 51 are provided. The bearing portions 51 rotatably support drum shafts (not shown) provided at the one end side and the other end side in the longitudinal direction of the photosensitive drum 12. The bearing portions 51 protrude at the one end and the other end in the longitudinal direction of each of the cartridges 8. In FIG. 2, only one of the bearing portions 51 is illustrated. As illustrated in FIG. 1, when the tray 5 locates at the inside position IP of the main body 1, the bearing portion 51 is supported by a recess portion 50*a* of the mounting portion 50. Specifically, the one end side bearing portion 51 is supported by the recess portion 50*a* of the one end side mounting portion 50, whereas the other end side bearing portion 51 is supported by the recess portion 50*a* of the other end side mounting portion 50. Owing to contact between two slant portions 50*b* of the recess portion 50*a* and a circumferential surface 51*a* of the bearing portion 51, the positioning of a center position (axis position) of the photosensitive drum 12 with respect to the main body 1 is carried out. Further, each cartridge 8 is provide with a cartridge boss (a first rotation-regulated member) 52 at one end of the longitudinal direction, and a cartridge rib (a second rotation-regulated member) 53 at the other end thereof. The tray 5 is provided with first tray grooves (first rotation regulating members) 54 on the side plate 5*a* on one side, and second tray grooves (second rotation regulating members) 55 on the side plate 5*b* on the other side. Then, the respective cartridges 8 are mounted into the main body 1, the bosses 52 are supported by the grooves 54, and the ribs 53 are supported by the grooves 55. With this structure, when the cartridge 8 receives a rotation force from the main body 1, for rotating the drum 12, the cartridge 8 is regulated so as not to rotate about the bearing portion 51 as a center. Specifically, the rotation of the cartridge 8 about the drum 12 as the center is regulated. Consequently, the positioning of the cartridge 8 with respect to the main body 1 is carried out as the drum 12 being a center.

Light Emitting Member

Figure 3A:
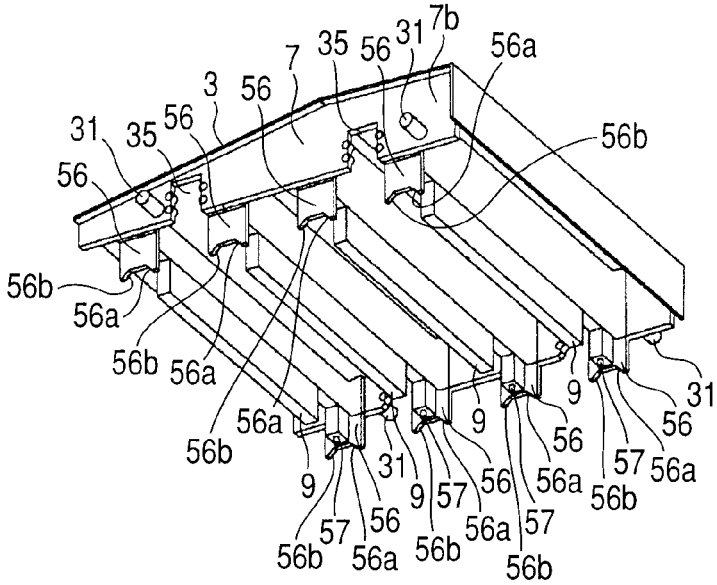
FIGS. 3A, 3B and 3C are views illustrating a support according to Embodiment 1 of the present invention.
Figure 11:
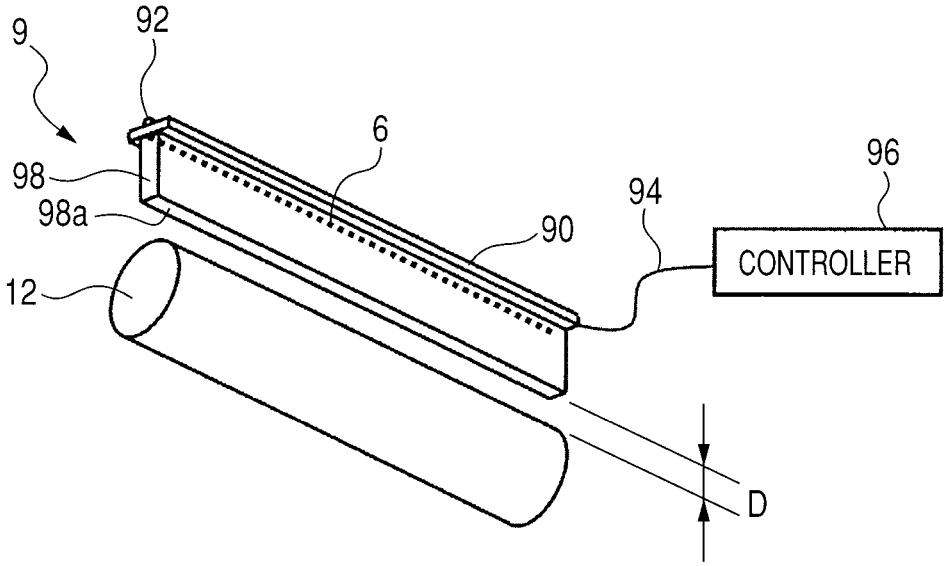
FIG. 11 is a perspective view of a light emitting member.

The main body 1 is provided with the light emitting member support 7 that supports the light emitting members 9. FIG. 3A is a perspective view of the support 7. In corresponding to four cartridges 8, four light emitting members 9 are provided on the support 7. Each of the light emitting members 9 includes a plurality of light emitting elements 6, which are provided side-by-side in the longitudinal direction (the axial direction) of the drum 12 of the cartridge 8 mounted on the main body 1 (FIG. 11). The longitudinal direction of the drum 12 is a direction orthogonal to the pullout direction X of the tray 5. The light emitting elements 6 emit light in accordance with an image information signal from a controller 96 (FIG. 11) to expose the drum 12. As the light emitting element 6, for example, a liquid crystal device (element), a semiconductor light emitting diode (LED), or an electroluminescence element such as an organic electroluminescence element (organic EL element) may be used. FIG. 11 is a perspective view of the light emitting member 9. The light emitting member 9 includes a substrate 90. The substrate 90 is supported by a holder (not shown). The holder fixes the substrate 90 to the support 7. On the front side of the substrate 90, the light emitting elements 6 are provided, and a driver IC 92 is provided on the back side. The light emitting elements 6 are electrically connected to the driver IC 92. The driver IC 92 controls a lighting operation of the light emitting elements 6. The substrate 90 is connected to the controller 96 of the main body 1 through a flexible flat cable (FFC) 94. In accordance with an image information signal from the controller 96, the driver IC 92 conducts the lighting operation of the light emitting elements 6. To the light emitting elements 6, a SELFOC (Registered Trademark) lens 98 is bonded. A front surface 98*a* of the lens 98 on the drum 12 side is a flat surface. The lens 98 condenses the light emitted from the light emitting elements 6, to form an image on the drum 12. When the support 7 locates at the exposure position LP (FIG. 1), the support 7 supports the light emitting members 9 so that the light emitting elements 6 face an image formation region in the longitudinal direction of the drum 12 (FIG. 3A). The exposure position LP is a position at which the drum 12 is exposed with the light emission of the light emitting elements 6, which being a position at which the plurality of light emitting elements 6 are provided side-by-side in the longitudinal direction of the drum 12. In this embodiment, in a state in which the support 7 locates at the exposure position LP, each of the plurality of light emitting elements 6 and the drum 12 are positioned at equal intervals.

It should be noted that, in this embodiment, each of the plurality of light emitting elements 6 and the drum 12 are positioned at the equal intervals at the exposure position LP, but the present invention is not limited thereto. For example, in a case where the sizes of the lenses 98 corresponding to the respective light emitting elements 6 differ from each other, the distances between the plurality of light emitting elements 6 and the drum 12 differ. The distance between each of the plurality of the light emitting elements 6 and the drum 12 is set so that the light emitted from the light emitting elements 6 is condensed by the lens 98 to form an image on the drum 12. Accordingly, depending on a specification of the lens 98, the plurality of light emitting elements 6 may be arranged in curve so that the distance between the light emitting elements 6 and the drum 12 becomes shorter at each of the both end portions in the axial direction of the drum 12, and becomes longer at the center portion in the axial direction. Alternatively, the plurality of light emitting elements 6 may be arrange in curve so that the distance between the light emitting elements 6 and the drum 12 becomes longer at each of the both end portions in the axial direction of the drum 12, and becomes shorter at the center portion in the axial direction.

Besides, the support 7 is provided inside the tray 3, and hence the support 7 is moved integrally with the tray 3. In this case, the inside of the tray 3 refers to a lower surface of the tray 3, which being the inside of the main body 1.

Positioning Members

The support 7 is provided with drum receiving portions (first regulating portions; front-back regulating portions) 56 and thrust bosses (second regulating portions; right-left regulating portions) 57 as the positioning members. The drum receiving portions 56 are provided at the corresponding positions on the one end side and the other end side, respectively, in the longitudinal direction of the cartridges 8. The thrust bosses 57 are provided on the one end side in the longitudinal direction of the cartridges 8. The receiving portions 56 and the bosses 57 perform the positioning of the cartridges 8, which have been mounted in the image formation positions with error within the allowable limits, with respect to the light emitting members 9. Note that, the image formation position refers to positions at which the cartridges 8 supported by the tray 5 are mounted on the mounting portions 50 in the main body 1, and the drums 12 are brought into contact with a transfer belt 18. The receiving portions 56 and the bosses 57 perform the positioning of the cartridges 8 with respect to the light emitting members 9, when the support 7 locates at the exposure position LP in a state in which the cartridges 8 are mounted on the mounting portions 50.

Figure 3B:
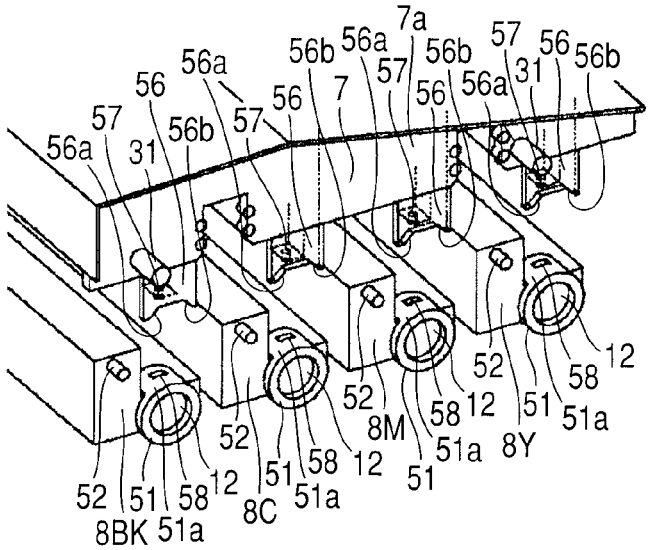

FIG. 3B is a perspective view for illustrating a method of positioning the drums 12 of the cartridges 8 with respect to the light emitting members 9. As illustrated in FIG. 3B, the positioning of the light emitting members 9 with respect to an orthogonal direction (a front-back direction) to the axial direction (the longitudinal direction) of the drums 12 is performed by supporting the receiving portions 56 as the light emitting element side positioning portions by the bearing portions 51 as the drum side positioning portions. The two slant surfaces 56*a* and 56*b* of each of the receiving portions 56 are brought into contact with the circumferential surface 51*a* of the bearing portion 51. With this, the light emitting member 9 is positioned with respect to the drum 12 in the front-back direction.

Further, the positioning of the light emitting members 9 with respect to the longitudinal direction (right-left direction) of the drums 12 is performed by inserting the bosses 57 into the cartridge grooves 58 formed in the cartridges 8. In this embodiment, the grooves 58 are formed in the bearing portions 51 on the one end side. The grooves 58 are formed to be long in the front-back direction so that the bosses 57 inserted into the grooves 58 are movable in the front-back direction. However, to position the light emitting members 9 with respect to the drums 12 in a right-left direction, the bosses 57 are just fitted into the grooves 58 in the right-left direction. The bosses 57 inserted into the grooves 58 do not move in the right-left direction.

Figure 3C:
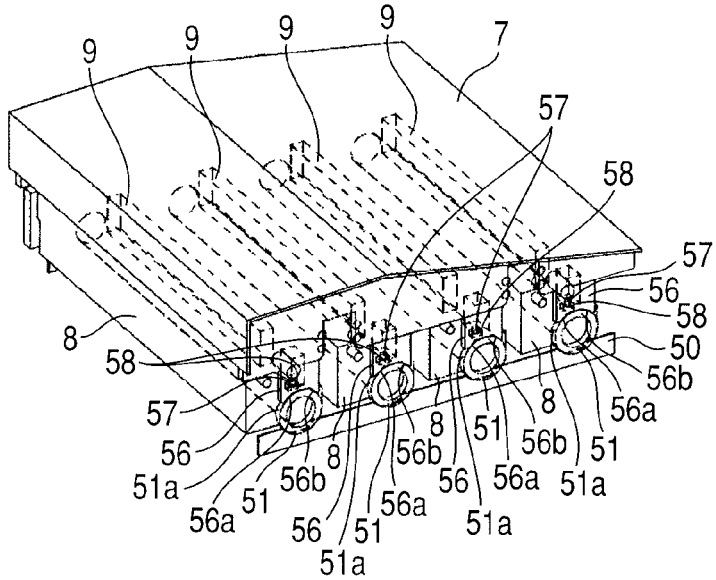

Besides, the positioning of the light emitting members 9 with respect to the vertical direction of the drums 12 is performed by supporting the receiving portions (light emitting element side positioning portions) 56 by the bearing portions (drum side positioning portions) 51. This is the same as the positioning in the front-back direction. The distance D between the surface of the drum 12 and the lens surface 98*a* of the light emitting member 9 is maintained to a predetermined distance by the contact between the two slant surfaces of the receiving portion 56 and the circumferential surface 51*a* of the bearing portion 51. FIG. 3C is a perspective view illustrating a state in which the light emitting members 9 are positioned with respect to the cartridges 8. FIG. 3C illustrates only the one end side bearing portions 51, and the other end side bearing portions 51 are omitted for explanation.

In this case, a forward side or a front surface side with respect to the main body 1 refers to a side on which a door (an openable and closable member) 2 is provided. A back side is an opposite side thereto. A direction (the front-back direction) orthogonal to the longitudinal direction of the drum 12 is a direction (a forward direction), which is directed from the back side to the front side of the main body 1 and a direction (a backward direction) opposite to the forward direction. The right-left refers to the right or left when viewed from the front side of the main body 1. The axial direction (the longitudinal direction; the right-left direction) of the photosensitive drum 12 refers to a direction (a left direction) which is directed from the right to the left and a direction (a right direction) opposite to the left direction. Note that, the door 2 can assume between a closing position for blocking the opening portion 10 and an opening position for opening the opening portion 10. As described above, in this embodiment, in a state in which the one end side bearing portions 51 are supported by the one end side mounting portions 50 and the other end side bearing portions 51 are supported by the other end side mounting portions 50, the light emitting members 9 are positioned with respect to the drums 12. In this case, in order that the light emitting member 9 be positioned at equal intervals with the drum 12 over the longitudinal direction of the drum 12, the one end side receiving portion 56 is supported by the one end side bearing portion 51 and the other end side receiving portion 56 is supported by the other end side bearing portion 51.

Figure 4A:
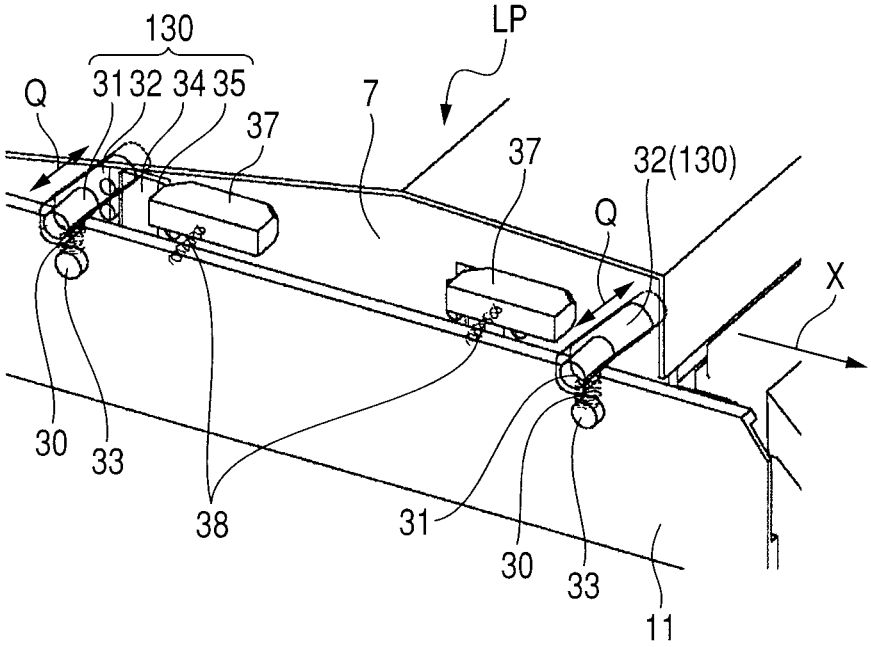
FIGS. 4A and 4B are perspective views illustrating an interlocking means according to Embodiment 1 of the present invention.

Further, FIG. 4A is a perspective view for illustrating a method of biasing the light emitting members 9 to the drums 12. As illustrated in FIG. 4A, the protruding portions 31 are provided on the support 7. Further, the guides 11 for supporting the tray 5 are provided with rail bosses 33. Further, extension springs (elastic members) 30 are attached between the protruding portions 31 and the bosses 33. The springs 30 urge the support 7 to the exposure position LP. With this biasing force (elastic force), the positions of the light emitting members 9 with respect to the photosensitive drums 12 in an up-down direction (a vertical direction) are regulated. The support 7 arranges the light emitting members 9 adjacently to the drums 12 so as to face the drums 12 at the exposure position LP. The distance D between the surface of the drum 12 and the surface 98*a* of the SELFOC (Registered Trademark) lens 98 of the light emitting member 9 is regulated to a predetermined distance at the exposure position LP. The predetermined distance is a distance, which is suited to the exposure of the drum 12. In this embodiment, the predetermined distance falls within a range of 2 mm or more and 3 mm or less. According to this embodiment, if the distance falls within the above-mentioned numerical values, owing to luminescence of the light emitting elements 6 in accordance with image information, the drum 12 is satisfactory exposed. In this embodiment, the distance between the surface of the drum 12 and the light emitting elements 6 including the lens 98 is 7 mm or more and 8 mm or less. However, if the specifications of the lens 98 are changed, the above-mentioned predetermined distance is changed because of change in a lens thickness or a focal depth. For example, the distance between the surface of the drum 12 and the light emitting elements 6 including the lens 98 may be set to 17 mm±0.8 mm, 10 mm±0.5 mm, 5 mm±0.3 mm, 4 mm±0.3 mm, and the like in accordance with the specifications of the lens 98. The distance D between the surface of the drum 12 and the lens surface 98*a* of the light emitting member 9 is maintained to the predetermined distance by the contact of the two slant surfaces 56*a*, 56*b* of the receiving portion 56 and the circumferential surface 51*a* of the drum bearing portion 51 (FIG. 3C).

Description of Image Formation Operation

At the time of image formation, the drums 12 rotate clockwise as indicated by arrows (FIG. 1). The surfaces of the drums 12 are uniformly charged by the charging rollers (charging members) 80. The light emitting elements 6 emit light in accordance with image information signals from the controller 96, and expose the charged surfaces of the drums 12 to form electrostatic latent images. The electrostatic latent images formed on the drums 12 are developed with the developers by the developing rollers (developing members) 81 into the developer images. The sheet 14, which is fed from the tray 13 by the roller 15 is transported to the transfer belt 18 in synchronism with timing of the developer images. The transfer belt 18 rotates counter clockwise (the direction indicated by arrows in FIG. 1), while electrostatically attracting the sheet 14. The sheet 14 is transported by the transfer belt 18, and passes transfer portions between the transfer belt 18 and the drums included in the cartridges 8Y, 8M, 8C, and 8BK, sequentially. With this operation, a yellow developer image, a magenta developer image, a cyan developer image, and a black developer image are transferred one after another superimposingly onto the sheet 14. After the transfer, the developers remained on the drums 12 are removed by the cleaning blades (cleaning members) 82. The sheet 14 is transported to a nip portion between the fixing film 20*a* and the pressure roller 20*b*. The developer image formed on the sheet 14 is heated and pressed at the nip portion, and is fixed onto the sheet 14. The sheet 14 having an image formed thereon is discharged onto the tray 3 by the roller pair 22*a*, 22*b*. Note that, from the figures other than FIG. 1, illustrations of the charging rollers 80, the developing rollers 81, and the cleaning blades 82 are omitted.

Description of Cartridge Replacement Method

Figure 5A:
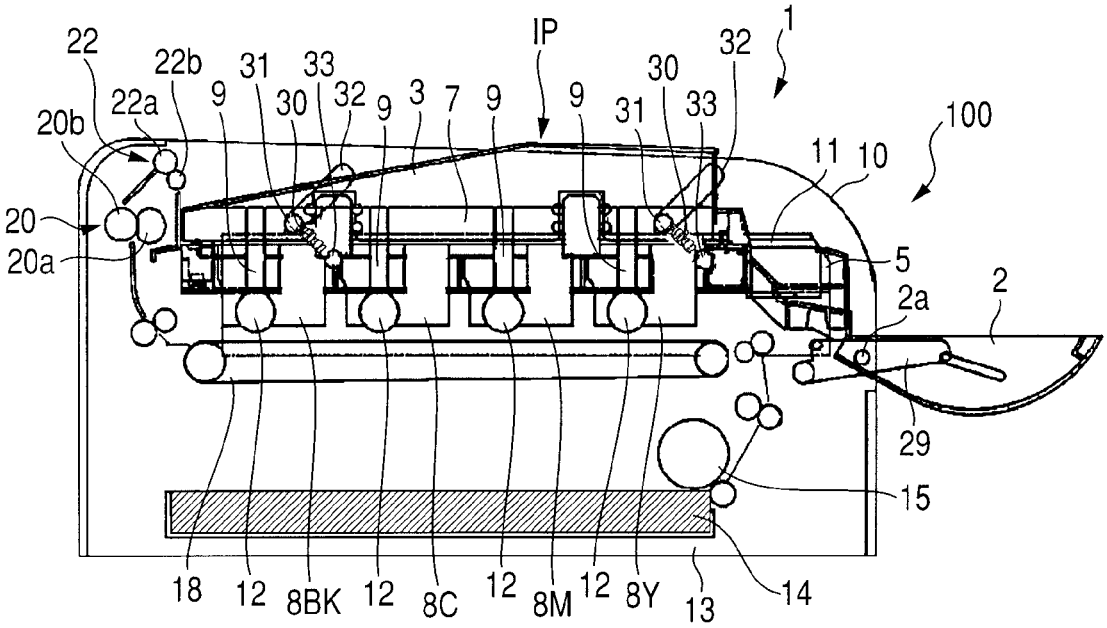
FIGS. 5A, 5B, and 5C are sectional views of the image forming apparatus for describing replacements of cartridges.
Figure 5B:
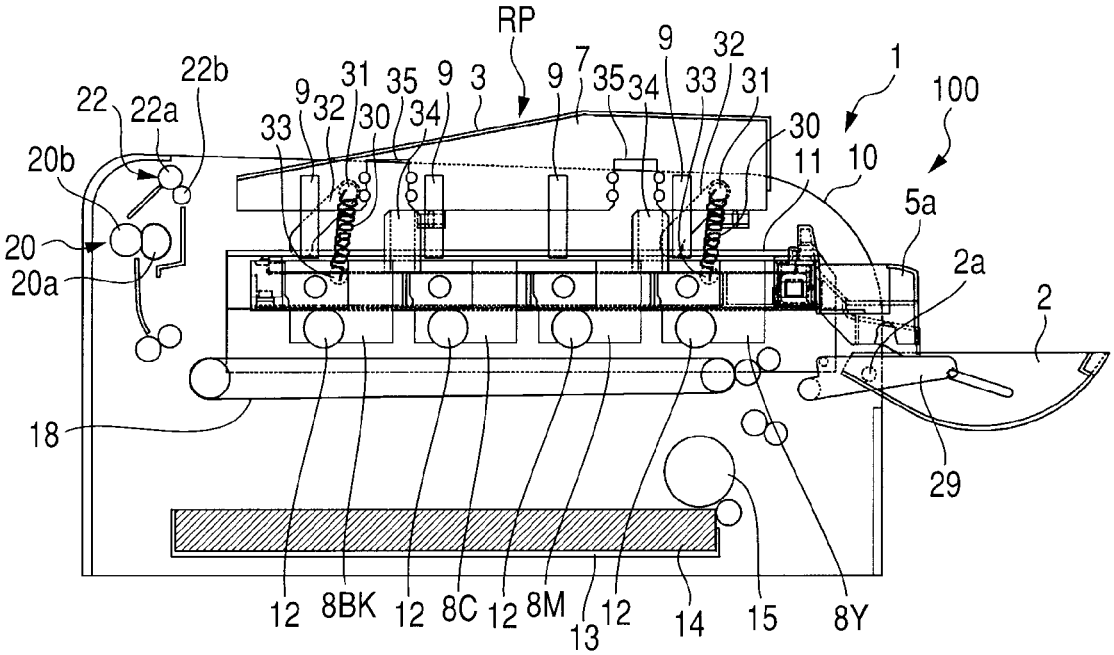
Figure 5C:
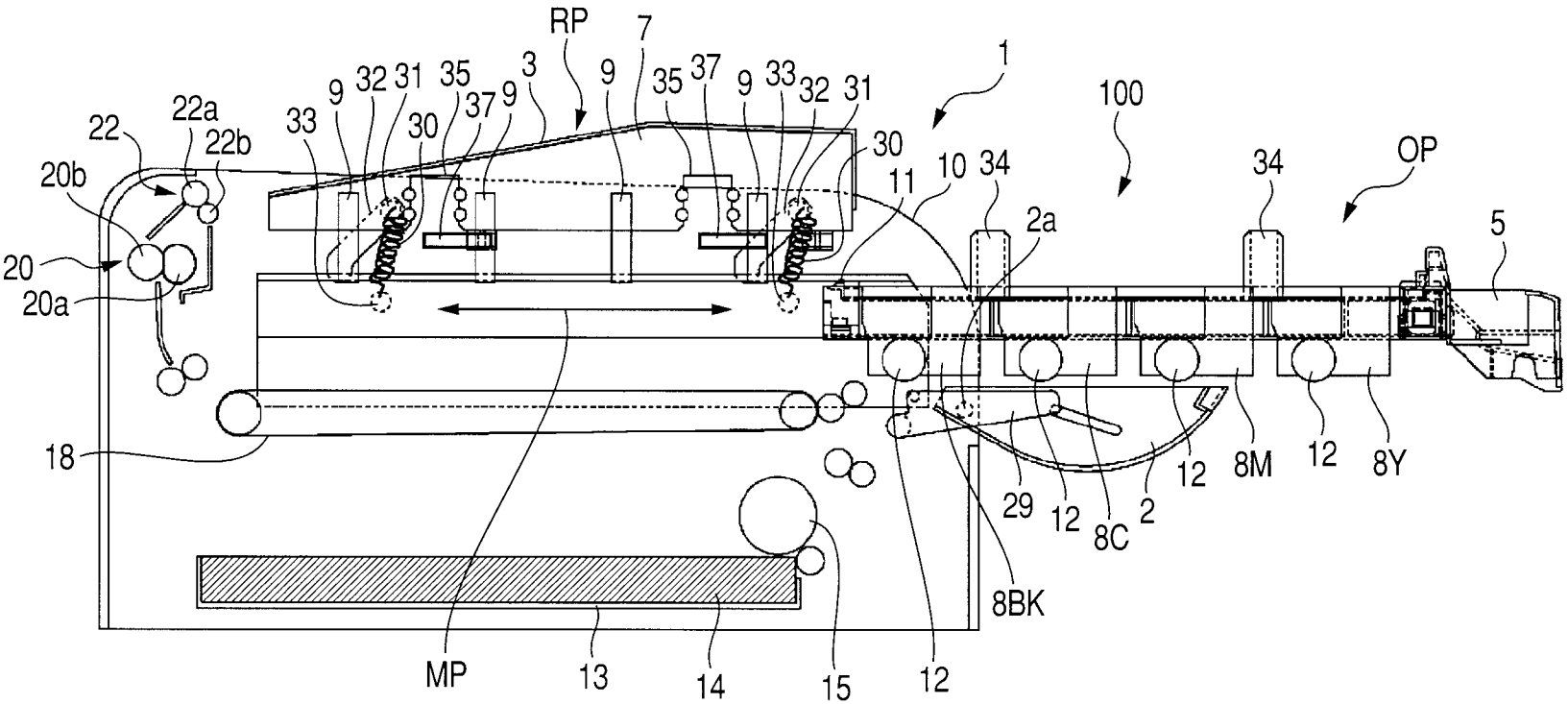
Figure 6A:
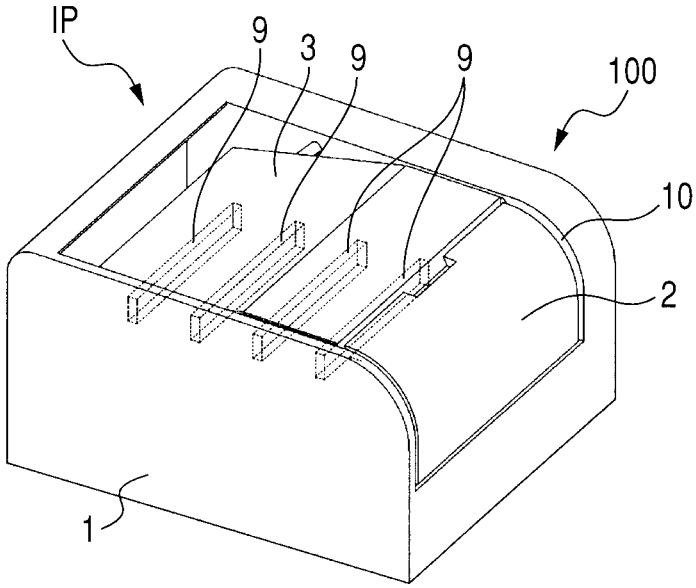
FIGS. 6A and 6B are perspective views of an apparatus main body according to Embodiment 1 of the present invention.
Figure 6B:
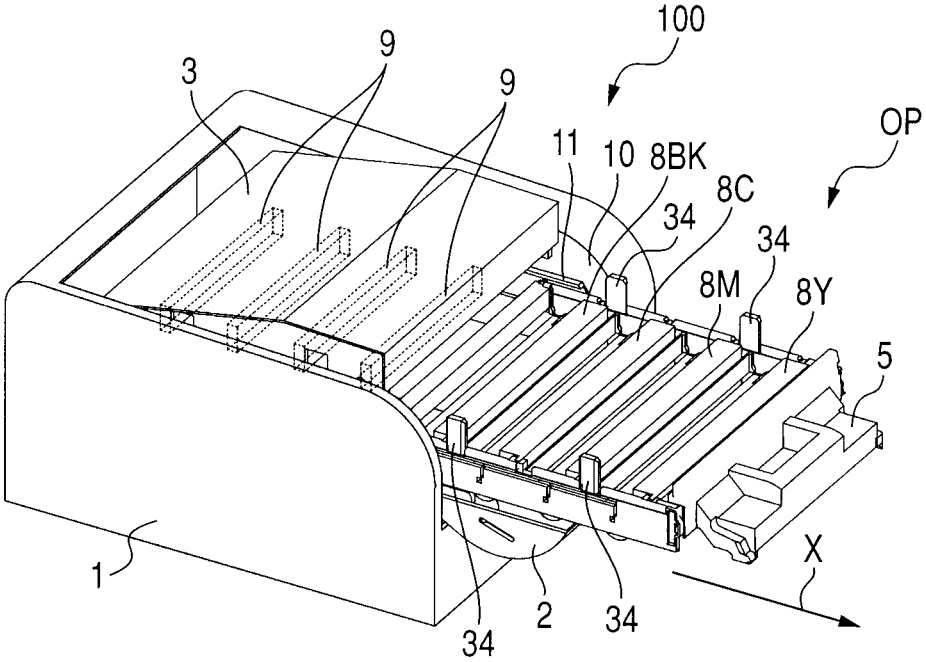

FIGS. 5A, 5B, and 5C are sectional views of the image forming apparatus, for illustrating a cartridge replacement method. FIGS. 6A and 6B are perspective views of the main body 1. Hereinafter, description is made of a method of replacing the cartridges. FIG. 6A is a perspective view of the main body 1 in which the door (the openable and closable member) 2 is closed. The door 2 is rotatably provided with respect to the main body 1 for opening and closing the opening portion 10 of the main body 1. The door 2 is rotated about a hinge 2*a* as a center to assume between a closing position for closing the opening portion 10 and an opening position for opening the opening portion 10. The user opens the door 2 to open the opening portion 10, and performs operations such as a jam clearance (removal of clogged sheet 14) and the replacement of the cartridges 8. FIG. 5A is a sectional view of the image forming apparatus in which the door 2 is opened. The tray 5 is supported with respect to the main body 1 by the guides 11, and is slidingly movable in a lateral direction (the front-back direction) in FIG. 5A. The tray 5 supports the cartridges 8 detachably. The tray 5 is movable through the opening portion 10 of the main body 1 between the outside position OP (refer to FIG. 5C) and the inside position IP (refer to FIG. 1) for positioning the cartridges 8 to the mounting portions 50 in the main body 1. Here, the outside position OP refers to a position outside the main body 1, and at which the user mounts the cartridge 8 to the tray 5 and detaches the cartridge 8 from the tray 5. Further, the inside position IP refers to the position for positioning the cartridges 8 to the mounting portions 50 in the main body 1. In this embodiment, the cartridges 8 locating at the inside position IP locate at the image formation positions (IP). The image formation positions (IP) refer to the positions at which the cartridges 8 contribute to form an image on the sheet 14. The tray 5 is moved by the user between the inside position IP and the outside position OP while passing through the opening portion 10. The door 2 engages to the guides 11 via a door link 29. When the user opens the door 2, the link 29 pulls out the guides 11 from a position illustrate in FIG. 1 to a position illustrated in FIG. 5A in association with the opening operation of the door 2. Simultaneously, the link 29 moves the guides 11 obliquely upward on the right side. Owing to the upward movement of the guides 11, the tray 5 supported by the guides 11 is moved upward. Owing to the upward movement of the tray 5, the drum 12 is separated from the transfer belt 18. Further, the bearing portions 51 are separated from the mounting portions 50. FIG. 5B is a view illustrating a state in which the door 2 is opened, and the tray 5 in the main body 1 is pulled out, whereby the support 7 is moved upward to the retracted position RP. The support 7 is automatically moved from the exposure position LP to the retracted position RP by the interlocking means (described later) in association with the movement of the tray 5 at the time when the user pulls out the tray 5. The retracted position RP is a position retracted from the exposure position LP. The retracted position RP is a position at which the support 7 (the light emitting members 9) does not interfere with the movement of the tray 5, which is supporting the cartridges 8. Besides, the retracted position RP is a position at which the support 7 (the light emitting members 9) does not collide with the moving tray 5 and the moving cartridges 8, which is moving while being supported by the tray 5. The support 7 is retracted from a moving path MP (FIG. 5C) in which the tray 5 is moved between the outside position OP and the inside position IP. As the support 7 is moved to the retracted position RP, the plurality of light emitting members 9 can be simultaneously retracted. When the support 7 locates at the retracted position RP, the light emitting members 9 exist within the main body 1. At the retracted position RP, the support 7 allows the movement of the tray 5 between the outside position OP and the inside position IP. That is, the support 7 does not interfere with the movement of the tray 5. With this, while leaving the support 7 in the main body 1, the tray 5 can be pulled out from the main body 1. FIG. 5C is a view illustrating the tray 5, which is pulled out from the inside position IP to the outside position OP. When the tray 5 locates at the outside position OP, the above of all the cartridges 8 supported by the tray 5 is opened. Then, the respective cartridges 8 can be removed upward. Further, all the cartridges 8 can be supported from the upward by the tray 5. Specifically, the attachment and detachment of the cartridges 8 with respect to the tray 5 may be performed in the vertical direction. Note that, according to this embodiment, when the cartridge 8BK, which locates most downstream in the pullout direction X (FIG. 4A), is attached and detached with respect to the tray 5, the entire length of the tray 5 may not locate at the outside position OP. Even in such cases, the tray 5 is pulled out toward the outside direction than a case where the cartridge 8BK locates at the image formation position (IP). Consequently, the cartridge 8BK is pulled out more, than in a case of locating at the image formation position, at a frontforward of the main body 1, it is easy for the user to replace the cartridge 8BK.

FIG. 6B is a perspective view of the main body 1 in a state in which the door 2 is opened and the tray 5 is pulled out. FIG. 6B illustrates the same state illustrated in FIG. 5C. In this state, the cartridges 8 are detachable from and mountable to the tray 5. Note that, the tray 5 moves in a horizontal direction with respect to an installation surface of the main body 1 (not shown). However, in this embodiment, it is not limited to this, and the tray 5 may move, for example, linearly and obliquely upward with respect to the installation surface (not shown), or linearly and obliquely downward. The tray 5 moves linearly in a direction orthogonal to the longitudinal direction of the cartridges 8 supported by (accommodated in, mounted on, attached to) the tray 5. Note that, the longitudinal direction of the cartridges 8 refers to the longitudinal direction of the photosensitive drum 12, or the longitudinal direction of the developing roller 81.

Operation of mounting the cartridges 8 to the main body 1 is performed by the reverse procedure with the operation of removing the cartridges 8. Specifically, the user pulls out the tray 5 to the outside position OP (refer to FIG. 5C), and the cartridges 8 is mounted on (supported by) the tray 5. The tray 5 having mounted the cartridges 8 thereon is pushed in the main body 1. In this case, the support 7 automatically moves from the retracted position RP to the exposure position LP by the interlocking means 130 (described later) in association with the movement of the tray 5 when the user pushes in the tray 5. The exposure position LP is a position in which the light emitting members 9 face the drums 12 and are positioned closely to the drums 12 to enable the exposure of the drums 12 in accordance with image information. Then, in association with the closing operation of the door 2 performed by the user, the guides 11 are pushed down to left downward from the position illustrated in FIG. 5A via the link 29. The tray 5 is moved downward together with the guides 11. With this operation, the cartridges 8 supported by the tray 5 are mounted to the mounting portions 50 in the main body 1. Then, the drums 12 are brought into contact with the transfer belt 18. This state is a state in which the cartridges 8 locate at the image formation positions. The image formation positions are positions at which the cartridges 8 contribute to form an image on the sheet (recording medium) 14.

Description of Retraction Method of Light Emitting Member Support

Next, a retraction method of the support 7 is described with reference to FIGS. 4A, 4B, 7A, 7B, 7C, 8A, and 8B.

Structure of Interlocking Means

Figure 4B:
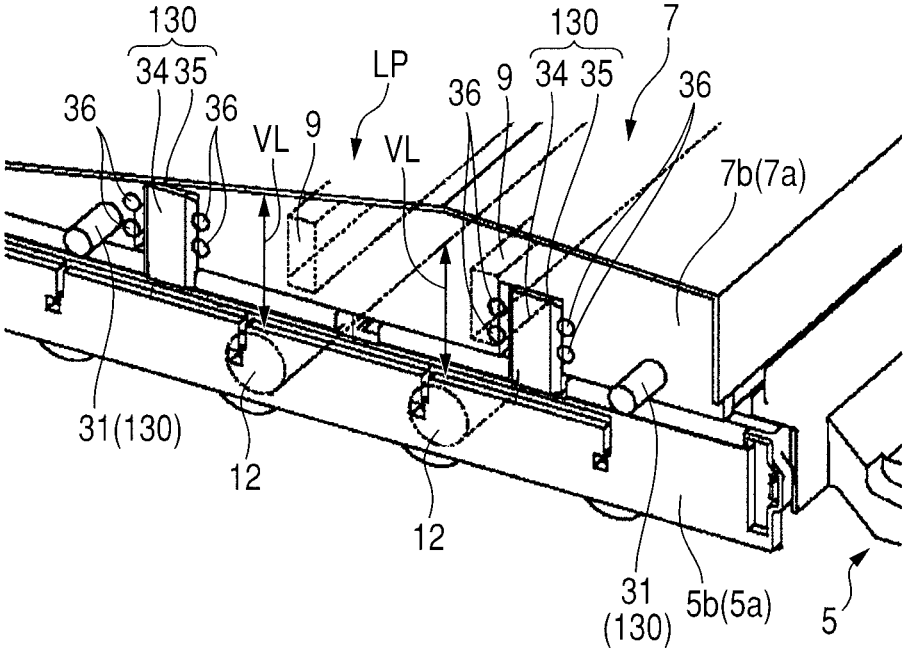

The image forming apparatus according to Embodiment 1 of the present invention includes an interlocking means 130, which moves the support 7 between the exposure position LP and the retracted position RP in association with the pullout and push-in operation of the tray 5 performed by the user. Here, at the exposure position LP, the light emitting members 9 are opposed closely to the drums 12 in order to expose the drums 12 by the luminescence of the plurality of light emitting elements 6 of the light emitting members 9. The plurality of light emitting elements 6 are arranged side-by-side in the longitudinal direction of the light emitting member 9. At the retracted position RP, the support 7 is retracted from the moving path MP in which the tray 5 is moved between the outside position OP and the inside position IP. FIGS. 4A and 4B illustrate a positional relation among the support 7, the guides 11, and the tray 5 in a state in which the door 2 is closed. The interlocking means 130 includes engagement projections (first engagement portions) 34, engagement grooves (second engagement portions) 35, protruding portions (third engagement portions) 31, and groove portions (fourth engagement portions) 32. The engagement projections 34 are provided on the tray 5. The engagement grooves 35 are formed in the support 7. The protruding portions (third engagement portions) 31 are provided on the support 7. The groove portions 32 are formed in the main body 1. The projections 34 are substantially rectangular members extending from the side plates 5*b* (5*a*) of the tray 5 upwardly. The groove portions 35 are generally substantially rectangular groove holes formed in side plates 7*b* (7*a*) of the support 7 and extending in the vertical direction. The projections 34 engage with the groove portions 35 so as to be slidable in the groove portions 35 in the vertical direction. The groove portions 35 engage with the projections 34, and support the support 7 with respect to the tray 5 so that the support 7 is movable along a direction of a straight line connecting the light emitting member 9 and the center of the drum 12. Here, the direction of the straight line connecting the light emitting elements 6 and the center of the drum 12 is a direction represented by arrows VL (FIG. 4B). That is, the light emitting member 9 is moved linearly and in parallel to the axis of the drum 12. With this, compared to a case in which the light emitting members 9 are rotated about a fulcrum as a center in the conventional art, the light emitting members 9 (the light emitting elements 6) may be moved between the exposure position LP and the retracted position RP even in the smaller space in the embodiment. The protruding portions 31 are inserted into the groove portions 32, and are slidingly movable in the groove portions 32. The protruding portions 31 slide in the groove portions 32. With this, the support 7 is movable with respect to the main body 1, as illustrated in FIG. 4A, in an oblique direction Q with respect to the pullout direction X. That is, by the engagement of the protruding portions 31 and the groove portions 32, the support 7 is moved with respect to the main body 1 linearly along the oblique direction Q with respect to the movement direction (the pullout direction X and the push-in direction Y) of the tray 5. In a state in which the door 2 is closed (as illustrated in FIGS. 4A and 4B), the extension spring (an elastic member or a bias member) 30 is connected between the protruding portion 31 and the rail boss 33 provided on the guides 11. In the support 7, the light emitting members 9 are biased (pulled) to the exposure position LP by the elastic force of the springs 30.

Function of Interlocking Means

Figure 7A:
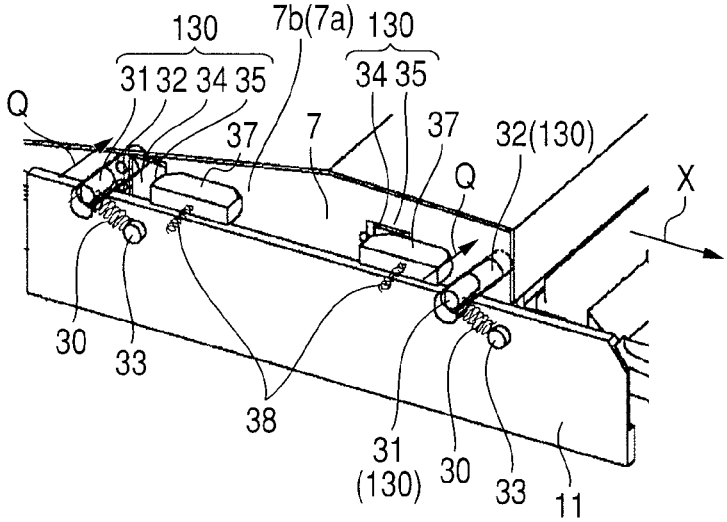
FIGS. 7A, 7B, and 7C are perspective views illustrating the interlocking means according to Embodiment 1 of the present invention.
Figure 7B:
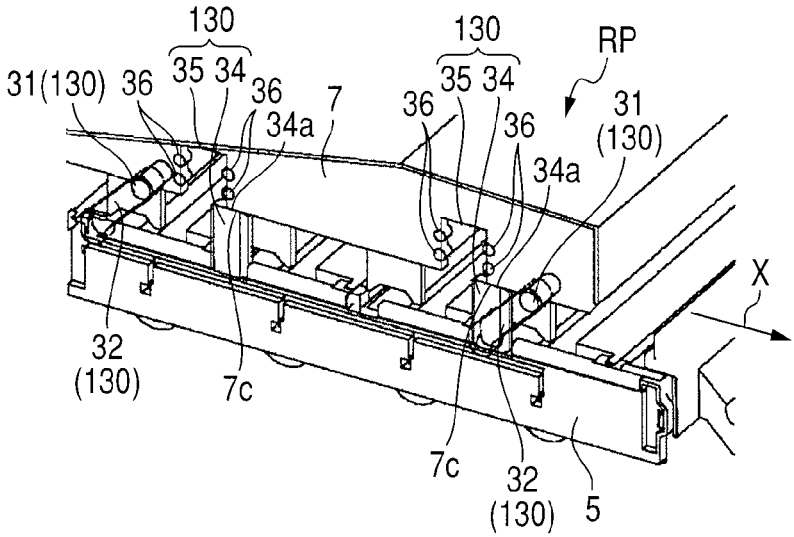

FIG. 7A illustrates a state in which the door 2 is opened, and is the same state as illustrated in FIG. 5A. As illustrated in FIG. 7A, when the door 2 is opened, the tray 5 is moved upward in association with the upward movement of the guides 11. With this, the support 7 is also moved upward. In this state, when the user pulls out the tray 5, the support 7 is pulled out in the pullout direction X by the engagement of the projections 34 of the tray 5 and the groove portions 35 of the support 7. In this case, the support 7 is regulated so as to be able to move in a direction only indicated by arrows Q (FIG. 7A) with respect to the main body 1, through the engagement of the protruding portions 31 and the groove portions 32. Therefore, the support 7 is moved linearly in the direction indicated by the arrows Q with respect to the main body 1 (obliquely upward with respect to pullout direction X of tray 5). Further, the support 7 is regulated so as to be able to move linearly and upwardly in the vertical direction only with respect to the tray 5 by the projections 34 and the groove portions 35 (in the direction indicated by the arrows VL in FIG. 4B). With this, the light emitting members 9 are retracted linearly and upwardly in the vertical direction (in the direction indicated by the arrows VL) with respect to the drums 12 of the cartridges 8. The support 7 is linearly moved from the exposure position LP to the retracted position RP. Besides, each of the groove portions 35 are provided with rotatable roller members (friction reducing members) 36. When the tray 5 is moved, a part of the tray 5 is brought into contact with the roller members 36 so that the roller members 36 are rotated. With this rotation, the friction between the projections 34 and the groove portions 35 is reduced. Owing to this, the support 7 is smoothly moved in the up-down direction with respect to the tray 5. FIG. 7B illustrates a state in which the support 7 is moved up to the retracted position RP, and is the same state as illustrated in FIG. 5B. The retracted position RP locates at the downstream and upward of the exposure position LP in the pullout direction X in which the tray 5 is moved from the inside position IP to the outside position OP. In this state, tops 34*a* of the projections 34 support the bottom portion 7*c* of the support 7. With this, the return of the support 7 from the retracted position RP to the exposure position LP caused by the springs 30 is regulated.

Figure 7C:
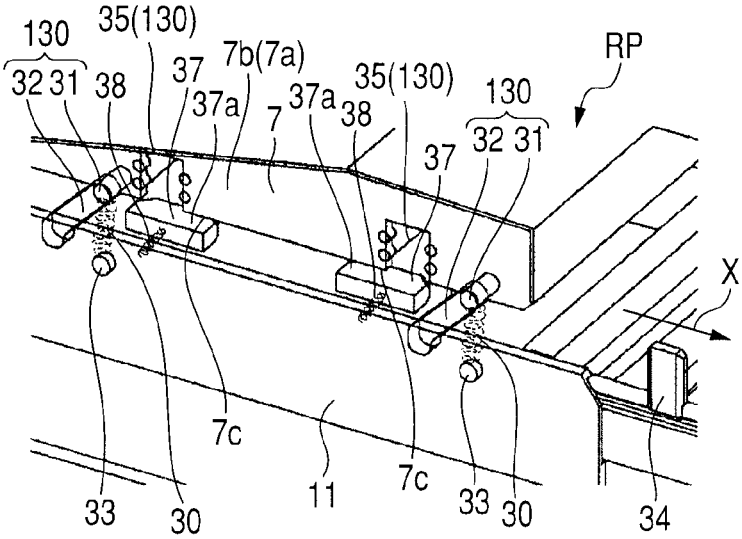

Supporting bosses 37 are provided in the main body 1 for retaining (supporting) the support 7 at the retracted position RP. The bosses 37 are biased (pulled) toward the inside of the main body 1 by elastic forces of boss springs (elastic members) 38. When the support 7 locates at the exposure position LP, the bosses 37 are biased by the elastic force of the boss springs 38 so as to abut against the side plate 7*b* of the support 7. Heights of upper surfaces 37*a* of the bosses 37 are set so as to be lower than the heights of the tops 34*a* of the projections 34. Thus, when the bottom portion 7*c* of the support 7 is supported by the tops 34*a* of the projections 34, the support 7 is delivered from the projections 34 to the bosses 37. That is, when the tray 5 is pulled out from the state illustrated in FIG. 7B in the pullout direction X, the support 7 is supported (retained) by the bosses 37 at the retracted position RP as illustrated in FIG. 7C. Further, in the state illustrated in FIG. 7B, the projections 34 regulate the bosses 37 from moving toward the inside of the main body. This is to prevent the movement of the support 7 from being obstructed by the bosses 37 being caught by the groove portions 35. Further, when the tray 5 is pulled out further from the state illustrated in FIG. 7B in the pullout direction X, the engagement between the bosses 37 and the projections 34 is released. The bosses 37 are protruded by the elastic forces of the springs 38 toward the inside of the main body to support (retain) the support 7 at the retracted position RP. With this, the support 7 is retracted from the movement path MP in which the tray 5 is moved between the outside position OP and the inside position IP. Consequently, the tray 5 is enabled to move to the outside position OP.

Figure 8A:
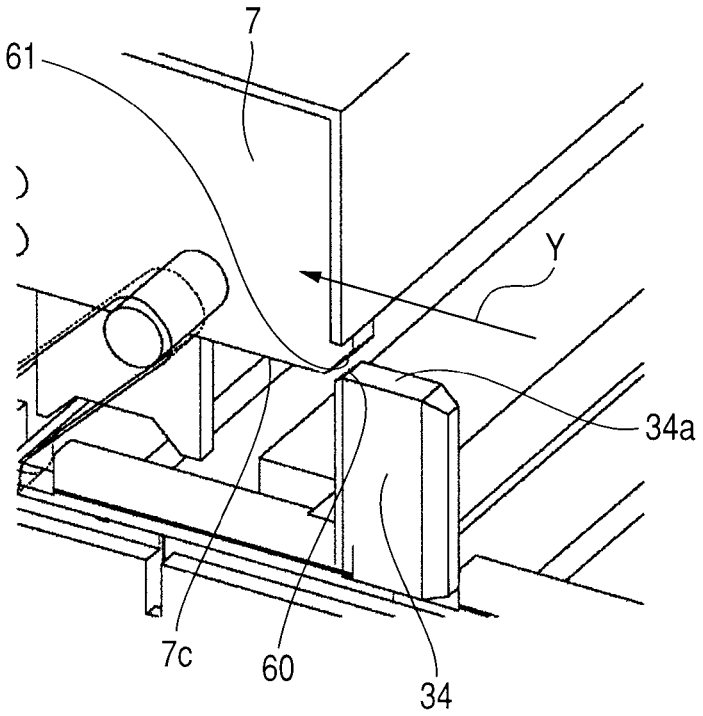
FIGS. 8A and 8B are perspective views of an engagement projection of the tray according to Embodiment 1 of the present invention.
Figure 8B:
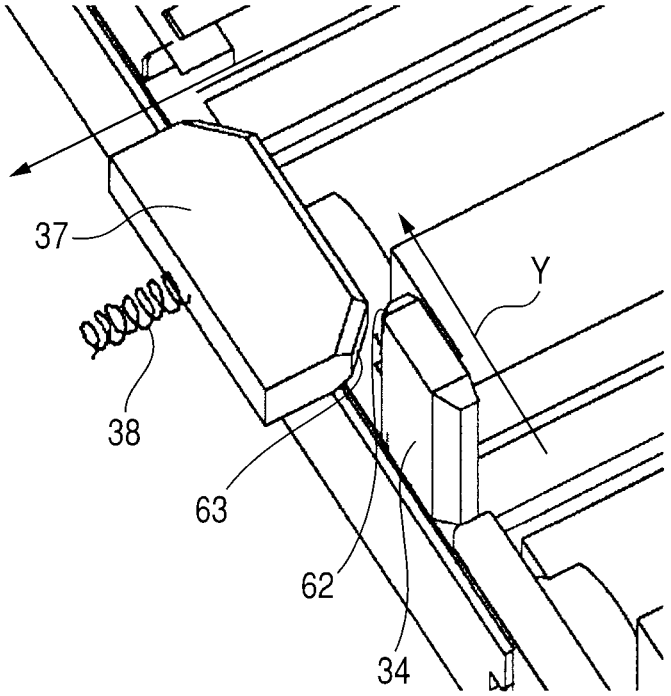

When mounting the cartridges 8 onto the main body 1, the user pushes in the tray 5 in a push-in direction Y, which is opposite to the pullout direction X. In association with the push-in operation, first, the support 7, which has located at the retracted position RP, is delivered from the upper surfaces 37*a* of the bosses 37 to the tops 34*a* of the projections 34. In this case, the bottom portion 7*c* of the support 7 before the delivery is lower than the tops 34*a* of the projections 34. Therefore, the bottom portion 7*c* of the support 7 is required to be elevated to the height of the tops 34*a* of the projections 34. As illustrated in FIG. 8A, first slant surfaces 60 are provided on the projections 34. Further, the support 7 is provided with a support slant surface 61. When the tray 5 is pushed in the push-in direction (the mounting direction) Y, the first slant surface 60 and the support slant surface 61 are engaged with each other. With this engagement, the support 7 is raised. The support 7 is raised by a height difference between the top surfaces 37 of the bosses 37 and the tops 34*a* of the projections 34. Thus, the support 7 is delivered from the bosses 37 to the projections 34. Further, as illustrated in FIG. 8B, the projections 34 are provided with second slant surfaces 62, and the support bosses 37 are provided with boss slant surfaces 63. When the tray 5 is further pushed in from the state illustrated in FIG. 8B in the push-in direction Y, the second slant surfaces 62 and the boss slant surfaces 63 are engaged with each other. With this engagement, the bosses 37 are retracted by the projections 34 to the outside of the main body 1. When the tray 5 is further pushed in from the state illustrated in FIG. 7B to the state illustrated in FIG. 7A, the projections 34 enter into the groove portions 35. When the user further pushes in the tray 5, the support 7 is pushed in the push-in direction Y by the engagement of the projections 34 of the tray 5 and the groove portions 35 of the support 7. At this time, the support 7 is regulated, by the engagement of the protruding portions 31 and the groove portions 32, so as to be movable only in a direction opposite to the direction indicated by arrows Q (FIG. 7A) with respect to the main body 1. For that reason, the support 7 is linearly moved, with respect to the main body 1, in the direction opposite to the direction indicated by arrows Q (a direction toward obliquely downward with respect to the push-in direction Y of the tray 5). Also, the support 7 is regulated, by the projections 34 and the groove portions 35, so as to move linearly in the vertical direction and downward only (the direction indicated by the allows VL of FIG. 4B) with respect to the tray 5. With this, the light emitting members 9 are moved linearly toward the drums 12 of the cartridges 8 (the direction indicated by the arrows VL). The support 7 is moved downward and upstream of the pullout direction X. Therefore, the support 7 is linearly moved from the retracted position RP to the exposure position LP.

As described above, according to Embodiment 1 of the present invention, the interlocking means 130 has the projections (the first engagement portions) 34 provided on the tray 5, the groove portions (the second engagement portions) 35 provided in the support 7, the protruding portions (the third engagement portions) 31 provided on the support 7, and the groove portions (the fourth engagement portions) 32 provided in the main body 1. The interlocking means 130 may automatically moves the support 7 to the retracted position RP in the main body 1 in association with the pull out operation of the tray 5 from the main body 1. As described above, the projections 34 are provided on the tray 5. The groove portions 35 are provided in the support 7, and engage with the projections 34 so as to move the support 7 with respect to the tray 5. The protruding portions 31 are provided on the support 7. The groove portions 32 are provided in the main body 1, and engage the protruding portions 31 so as to move the support 7 with respect to the main body 1. In association with the movement of the tray 5 toward the outside position OP, the support 7 is moved linearly and upwardly in the vertical direction with respect to the tray 5 by the engagement of the projections 34 and the groove portions 35 of the interlocking means 130. And, the support 7 is moved linearly and upwardly in the oblique direction with respect to the main body 1 by the engagement of the protruding portions 31 and the groove portions 32 of the interlocking means 130. With this, the support 7 is automatically moved from the exposure position LP to the retracted position RP in association with the movement of the tray 5. While, in association with the movement of the tray 5 toward the inside position IP, the support 7 is moved linearly and downward in the vertical direction toward the tray 5 by the engagement of the projections 34 and the groove portions 35 of the interlocking means 130. And, the support 7 is moved linearly and downward in the oblique direction with respect to the main body 1 by the engagement of the protruding portions 31 and the groove portions 32 of the interlocking means 130. With this, the support 7 is automatically moved from the retracted position RP to the exposure position LP.

With this, the cartridges 8 can be replaced by only pullout operation of the tray 5. Thus, according to Embodiment 1 of the present invention, enhancement of usability is realized. Further, when the tray 5 is pulled out from the main body 1, the support 7 does not come out outside the main body 1. Thus, the light emitting members 9 (the light emitting elements 6) may be restrained from adhering dust, and being marked. As a result, enhancement of the reliability of the image forming apparatus is attained further.

Embodiment 2

Figure 9A:
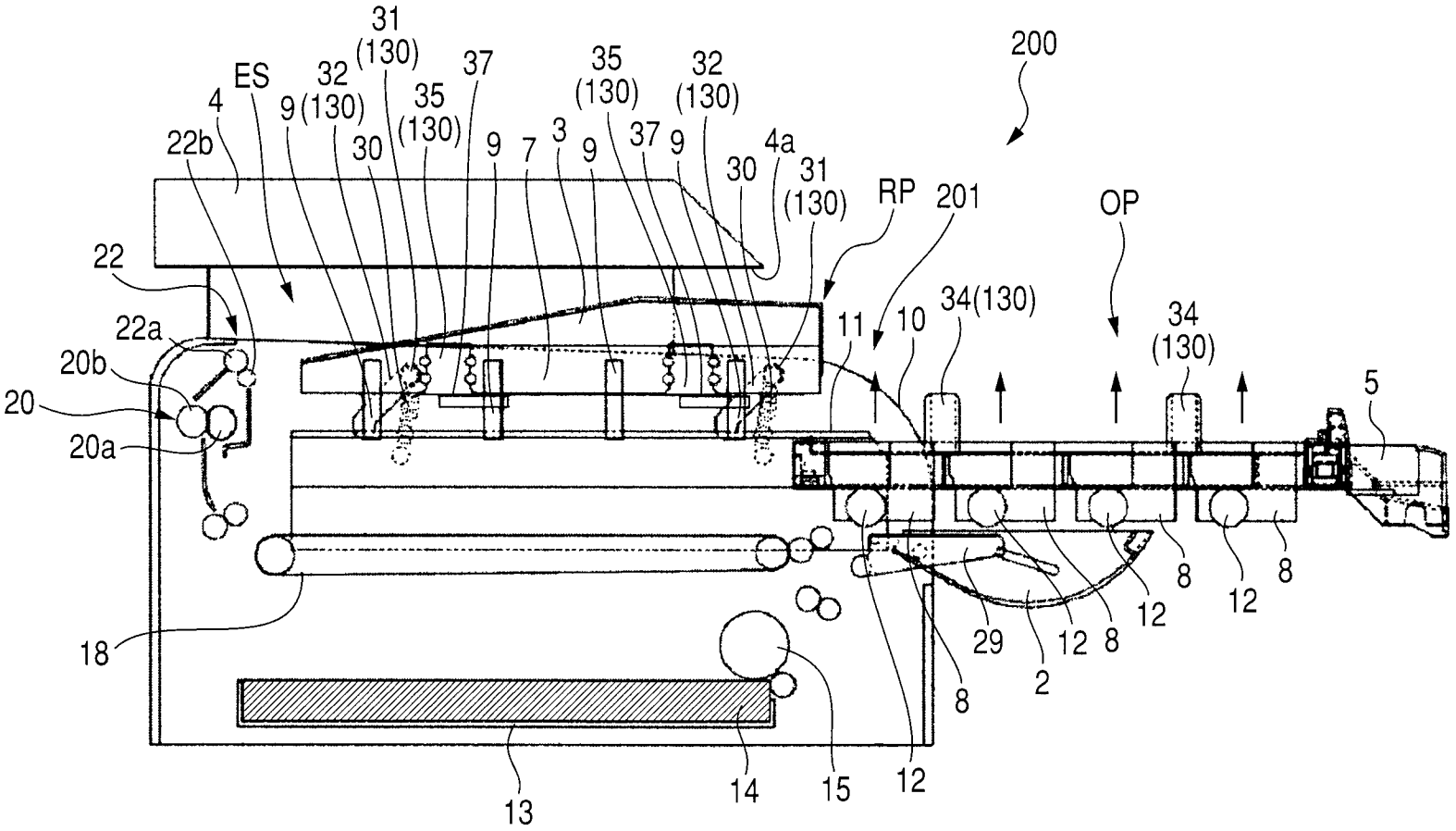
FIGS. 9A and 9B are views illustrating an image forming apparatus according to Embodiment 2 of the present invention.
Figure 9B:
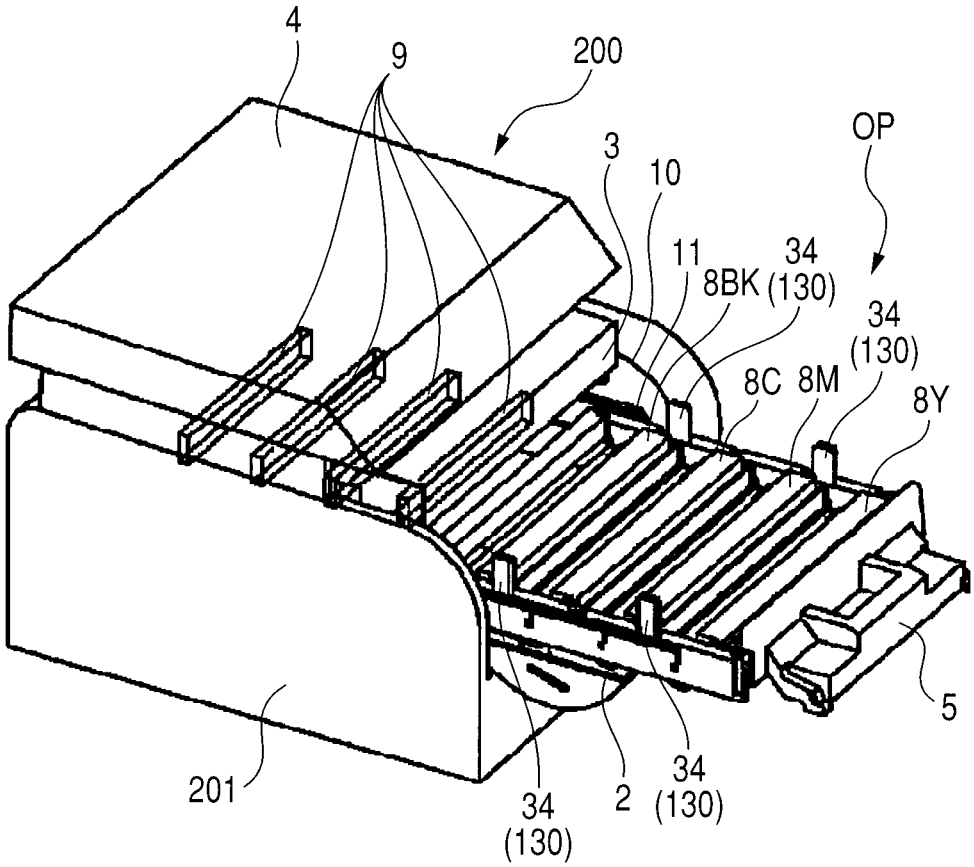

With reference to FIGS. 9A and 9B, a description will be provided of an image forming apparatus 200 to which Embodiment 2 of the present invention is applied. The same structures as those of Embodiment 1 of the present invention are denoted by the same reference numerals and the description thereof are omitted. The image forming apparatus 200 is a multifunction printer, which is abbreviated as MFP, for instance, and has functions of a copying machine, a printer, a scanner, a facsimile, and so on. As illustrated in FIGS. 9A and 9B, the apparatus 200 has an original reading apparatus (hereinafter, referred to as an image scanner) 4 provided above a main body 201 of the apparatus 200. The discharge tray 3 for receiving the sheet 14 having an image formed thereon is arranged below the scanner 4. Further, the discharge space ES to which the sheet 14 having an image formed thereon is discharged is defined between the tray 3 and the scanner 4. FIG. 9A is a sectional view of the main body 201 illustrating a state in which the tray 5 is moved up to the outside position OP. FIG. 9B is a perspective view of the main body 201, which is the same state as that in FIG. 9A. As illustrated in FIG. 9A, the apparatus 200 also has the interlocking means 130 as with Embodiment 1. The interlocking means 130 moves the support 7 automatically in association with the movement of the tray 5 by the user. In association with the pullout operation of the tray 5 to the outside position OP, the support 7 is moved from the exposure position LP to the retracted position RP by the interlocking means 130. As the support 7 is moved to the retracted position RP, the plurality of light emitting members 9 are simultaneously retracted. As with Embodiment 1, the interlocking means 130 has the projections 34 provided on the tray 5, the groove portions 35 provided in the support 7, the protruding portions 31 provided on the support 7, and the groove portions 32 provided in the main body 1. The support 7 is provided inside the tray 3. The support 7 and the tray 3 are supported by the main body 201 so as to be movable integrally with each other with respect to the main body 201. As illustrated in FIG. 9A, even if the support 7 is moved to the retracted position RP, the tray 3 does not come into contact with the bottom surface portion 4*a* of the scanner 4. A range within which the tray 3 is moved in association with the movement of the support 7 between the exposure position LP and the retracted position RP, falls within the discharge space ES between the scanner 4 and the tray 3. The discharge space ES is a space into which the sheet 14 having an image formed thereon is discharged. That is, in association with the movement of the support 7 between the exposure position LP and the retracted position RP, the tray 3 is moved within the space ES. As described above, according to Embodiment 2 of the present invention, even in a case where a large space cannot be secured above the main body 201, the cartridges 8 may be replaced without any trouble.

Embodiment 3

Figure 10A:
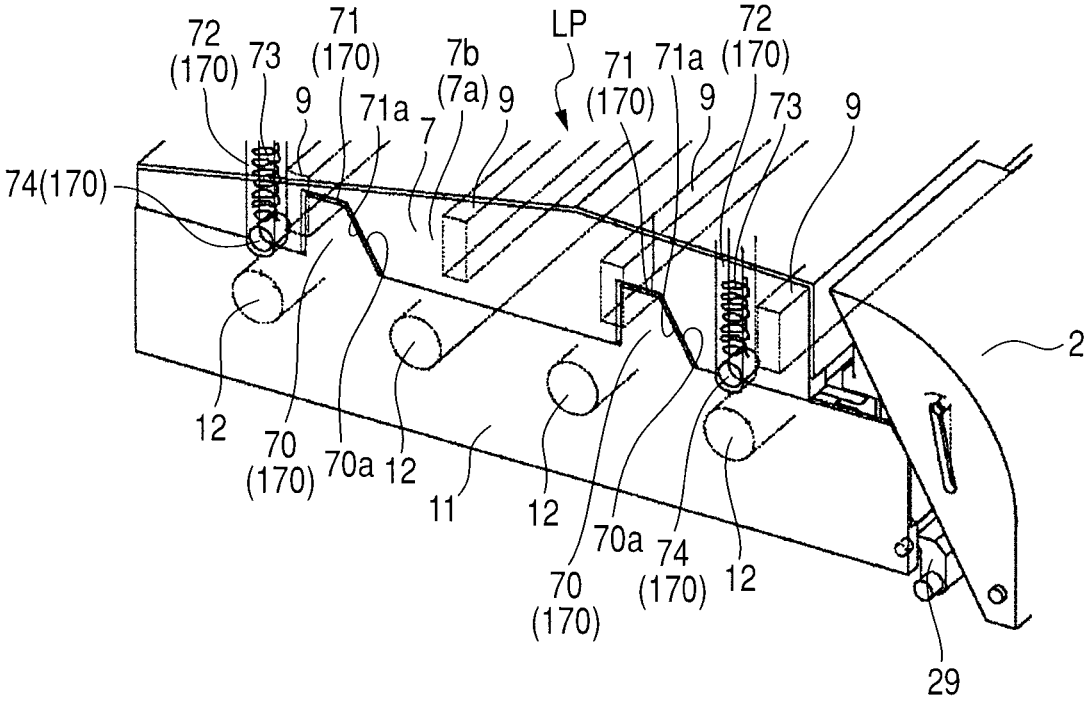
FIGS. 10A and 10B are perspective views of an interlocking means according to Embodiment 3 of the present invention.
Figure 10B:
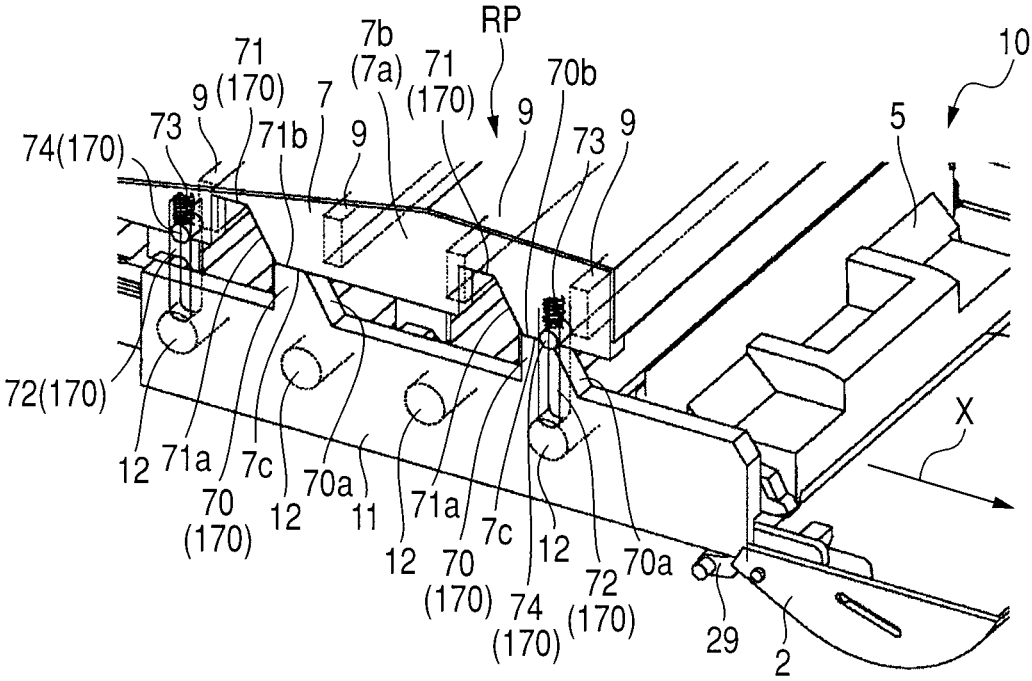

Referring to FIGS. 10A and 10B, the image forming apparatus according to Embodiment 3 of the present invention will be described. An interlocking means 170 according to Embodiment 3 of the present invention automatically moves the support 7 from the exposure position LP to the retracted position RP in association with the movement of the tray 5 toward the outside position OP, which interlocks with the operation of opening the door (the openable and closable member) 2 by a user. As described above, the tray 5 is moved toward the outside position OP in association with the operation of opening the door 2 by the user. Then, in association with the movement of the tray 5 toward the outside position OP, the support 7 is moved from the exposure position LP to the retracted position RP. While, the tray 5 is moved toward the inside position IP in association with the closing operation of the door 2. Then, in association with the movement of the tray 5 toward the inside position IP, the support 7 is moved from the retracted position RP to the exposure position LP. The tray 5 is supported by the guides 11. The guides 11 are moved together with the tray 5 in association with the opening and closing operation of the door 2. The movement of the tray 5 in association with the opening and closing operation of the door 2 is performed through the guides 11. The guides 11 and the support 7 are provided with the interlocking means 170.

FIGS. 10A and 10B are perspective views of the interlocking means 170 according to Embodiment 3. The interlocking means 170 according to Embodiment 3 moves the support 7 from the exposure position LP to the retracted position RP in association with the opening operation of the door 2. While, the interlocking means 170 moves the support 7 from the retracted position RP to the exposure position LP in association with the closing operation of the door 2. Hereinafter, a description will be provided of the interlocking means 170 according to Embodiment 3.

FIG. 10A is a view illustrating the interlocking means 170 in a state in which the door 2 is closed. The guides 11 support the tray 5 for a slide movement in the front-back direction. The interlocking means 170 has engagement projections (fifth engagement portions) 70, the engagement grooves (sixth engagement portions) 71, the protruding portions (seventh engagement portions) 74, and the groove portions (eighth engagement portions) 72. The projections 70 are provided on the guides 11. Each of the projections 70 has a first guide slant surface 70*a*. The groove portions 71 are provided in the support 7. Each of groove portions 71 has a second guide slant surface 71*a*. The second slant surfaces 71*a* engage with the first slant surfaces 70*a*. The groove portions 72 are provided in the main body, and extend in the up-down direction of the main body. The protruding portions 74 protrude outwardly from the side plates 7*b* (7*a*) of the support 7.

The protruding portions 74 of the support 7 are inserted into the groove portions 72 of the main body, and are slidable within the groove portions 72 in the up-down direction. The movement of the support 7 with respect to the main body in the front-back direction is regulated by the engagement of the protruding portions 74 and the groove portions 72. With this, the support 7 is movable only in the up-down direction with respect to the main body. Compression springs (elastic members) 73 are arranged between the main body 1 and the protruding portions 74 within the groove portions 72. The elastic forces of the springs 73 bias (pull) the support 7 to the exposure position LP. The retracted position RP of the support 7 locates just above the exposure position LP (upward in the vertical direction). Note that, the retracted position RP is unnecessary to be exactly on the vertical line passing the exposure position LP. It is needless to say that the retracted position RP may slightly be shifted from the vertical line. Further, the groove portions 72 of the main body may be provided with an inclination with respect to the vertical line.

FIG. 10B is a view illustrating the interlocking means 170 when the door 2 is opened. When the user opens the door 2, as in Embodiment 1 and Embodiment 2, the link 29 causes the guides 11 to move upward. At the same time, the link 29 pulls out the guides 11 at a predetermined distance in the pullout direction X. Accordingly, the guides 11 is moved upward and downstream in the pullout direction X in association with the opening operation of the door 2. The tray 5 supported by the guides 11 is also moved upward and toward the outside position together with the guides 11 by a predetermined amount in association with the opening operation of the door 2. When the guides 11 is pulled out by the predetermined distance in the pullout direction X, the support 7 is moved upward with respect to the guides 11 by the engagement of the first guide slant surfaces 70*a* and the second guide slant surfaces 71*a*. Note that, by the engagement of the protruding portions 74 and the groove portions 72, the support 7 is not moved in the pullout direction X, but is moved linearly upward with respect to the main body 1 (moved in the vertical direction only). That is, when the support 7 is moved from the exposure position LP to the retracted position RP, the light emitting members 9 are moved linearly in parallel to the axes of the drums 12. As the support 7 is moved to the retracted position RP, the plurality of light emitting members 9 are simultaneously retracted.

As illustrated in FIG. 10B, in a state in which the door 2 is opened, the tops 70*b* of the projections 70 support the bottom portions 7*c* of the side plates 7*b* (7*a*) of the support 7. As the bottom portions 7*c* are supported by the tops 70*b*, the support 7 is supported (retained) at the retracted position RP. At this time, the tops 70*b* regulate the support 7 from being returned to the exposure position LP by the elastic force (bias force) of the springs 73. The light emitting members 9 are retracted from the movement path MP in which the tray 5 is moved between the outside position OP and the inside position IP. Thus, the tray 5 may be pulled out to the outside position OP without receiving the obstacle by the light emitting members 9.

On the other hand, when the user closes the door 2, the link 29 moves the guides 11 downward and downstream in the push-in direction (upstream in the pullout direction X). The tray 5 supported by the guides 11 is also moved together with the guides 11 downward and toward the inside position IP by only a predetermined amount in association with the closing operation of the door 2. Along with the downward movement of the guides 11, the support 7 is moved only straight and downward (only downward in the vertical direction). When the guides 11 are moved upstream in the pullout direction X, the engagement of the tops 70*b* and the bottom portion 7*c* is released, and subsequently, the first guide slant surfaces 70*a* engage with the second guide slant surfaces 71*a*. When the guides 11 are further pushed in association with the closing operation of the door 2, the second guide slant surfaces 71*a* move downward along the first guide slant surfaces 70*a*. Along with the downward movement of the second guide slant surfaces 71*a*, the support 7 is moved downward with respect to the guides 11. By the engagement of the protruding portions 74 and the groove portions 72, the support 7 is not moved in the push-in direction Y, but is moved linearly downward with respect to the main body 1 (downward in the vertical direction only). That is, when the support 7 is moved from the retracted position RP to the exposure position LP, the light emitting members 9 are moved linearly in parallel to the axes of the drums 12. With this, compared to a case in which the light emitting members 9 are rotated about a fulcrum as a center, the light emitting members 9 (light emitting elements 6) according to this embodiment may be moved between the exposure position LP and the retracted position RP even in the smaller space. When the door 2 is closed, the support 7 locates at the exposure position LP (FIG. 10A).

According to Embodiment 3, in association with the opening operation of the door 2 by the user, the guides 11 are moved upward and downstream in the pullout direction X. As the tray 5 is supported by the guides 11, in association with the opening operation of the door 2, the tray 5 is moved together with the guides 11 upward and downstream in the pullout direction X. Then, in association with the movement of the tray 5 and the guides 11 to the outside position OP, the support 7 is moved from the exposure position LP to the retracted position RP by the interlocking means 170. On the other hand, in association with the closing operation of the door 2 performed by the user, the guides 11 are moved downward and upstream in the pullout direction X. Thus, in association with the closing operation of the door 2, the tray 5 supported by the guides 11 is moved together with the guides 11 downward and upstream in the pullout direction X. In association with the movement of the tray 5 and the guides 11 toward the inside position IP, the support 7 is automatically moved from the retracted position RP to the exposure position LP by the interlocking means 170. As described above, the interlocking means 170 has the engagement projections 70 provided on the guides 11, and the engagement grooves 71 provided in the support 7 for engaging with the engagement projections 70 to move the support 7 with respect to the guides 11. Further, the interlocking means 170 has the protruding portions 74 provided on the support 7, and the groove portions 72 provided in the main body 201 for engaging with the protruding portions 74 to move the support 7 with respect to the main body 201. In association with the movement of the tray 5 toward the outside position OP, the support 7 is moved upward with respect to the guides 11 by the engagement of the projections 70 and the groove portions 71. And, the support 7 is moved linearly and upward with respect to the main body 201 by the engagement of the protruding portions 74 and the groove portions 72. With this, the support 7 is automatically moved from the exposure position LP to the retracted position RP. Then, in association with the movement of the tray 5 toward the inside position IP, the support 7 is moved downward with respect to the guides 11 by the engagement of the projections 70 and the groove portions 71. And, the support 7 is moved linearly and downward with respect to the main body 201 by the engagement of the protruding portions 74 and the groove portions 72. With this, the support 7 is automatically moved from the retracted position RP to the exposure position LP.

As described above, the interlocking means 170 according to Embodiment 3 has the projections 70 provided on the guides 11, the groove portions 71 provided in the support 7, the protruding portions 74 provided on the support 7, and the groove portions 72 provided in the main body 1. In association with the opening operation of the door 2 by the user, the tray 5 is moved toward the outside position OP. Then, in association with the movement of the tray 5 toward the outside position OP, the interlocking means 170 automatically move the support 7 up to the retracted position RP in the main body 1. As the support 7 is moved to the retracted position RP, the plurality of light emitting members 9 are automatically retracted at the same time. With this, by the pull out operation of the tray 5 only, the cartridges 8 can be replaced. Further, as in Embodiment 1 and Embodiment 2 described above, when the tray 5 is pulled out from the main body 1, the support 7 does not come out of the main body 1.

Note that, in the above-mentioned respective embodiments, the description was provided of, by way of example, a so-called integral type process cartridge as a cartridge. But the present invention is not limited to a case where the process cartridge is used. As the cartridge 8, the cartridge having the above-mentioned structure may be appropriately applicable. Further, the present invention is applicable to a case where the respective cartridges 8 are supported by the tray 5 in a direction along which the longitudinal direction of the cartridges 8 is running in (parallel to) the movement direction of the tray 5. In addition, as the photosensitive drum 12 is provided in the process cartridge 8 as the cartridge, the photosensitive drum 12 is attached to the tray 5 in a state in which the cartridges 8 are supported by the tray 5. Besides, without limiting to this embodiment, the present invention includes a case in which the photosensitive drums 12 are fixed to the tray 5 so as to be rotatable.

According to the above-mentioned respective embodiments, there may be improved operability for operating the support (the light emitting member support) 7. In the electrophotographic image forming apparatus, in association with the movement of the tray (the cartridge supporting member) 5 toward the outside position OP, the support 7 can be automatically moved from the exposure position LP to the retracted position RP. In the electrophotographic image forming apparatus, in association with the movement of the tray 5 toward the inside position IP, the support 7 can be automatically moved from the retracted position RP to the exposure position LP. In the electrophotographic image forming apparatus, in association with the movement of the tray 5 toward the outside position OP, the support 7 can be automatically moved from the exposure position LP to the retracted position RP, and in association with the movement of the tray 5 toward the inside position IP, the support 7 can be automatically moved from the retracted position RP to the exposure position LP.

Note that, in Embodiment 1 and Embodiment 2, the interlocking means 130 is exemplified, and in Embodiment 3, the interlocking means 170 is exemplified, but the present invention is not limited to those interlocking means. As the interlocking means, for example, by appropriately combining spring, link, compressed air, and the like, the light emitting members 9 may be moved so that the light emitting members 9 may assume between the exposure position LP and the retracted position RP. For example, one end and the other end of the light emitting member 9 in the longitudinal direction are engaged with the main body side guides (for example, grooves). Then, the light emitting member 9 is moved along the guides by the elastic force of the spring in the direction approaching to the drum 12. With this, the light emitting member 9 is moved from the retracted position RP to the exposure position LP. Besides, the light emitting member 9 is moved using a lever or the like along the guides in the direction away from the drum 12. With this, the light emitting member 9 is moved from the exposure position LP to the retracted position RP. The interlocking means may be constructed as described above. Besides, for example, the interlocking means may be constructed such that a cam member which rotates in association with the movement of the tray 5 is provided in the main body 1, and the follower that engages with the cam member is provided on the support 7. In association with the movement of the tray 5 toward the outside position OP, the cam member is rotated, and the support 7 may automatically be moved from the exposure position LP to the retracted position RP by the follower that engages with the cam member. While, in association with the movement of the tray 5 toward the inside position IP, the cam member is rotated, and the support 7 may automatically be moved from the retracted position RP to the exposure position LP by the follower that engages with the cam member.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2009-196714, filed Aug. 27, 2009, and No. 2009-290041, filed Dec. 22, 2009 which are hereby incorporated by reference herein in their entirety.

The invention claimed is:

1. An image forming apparatus which forms an image on a recording medium, the image forming apparatus comprising:

a cartridge including a photosensitive member and configured to be removed from a main body of the image forming apparatus;

a light emitting member having a plurality of light emitting elements arranged in a rotation axis direction of the photosensitive member and configured to make the plurality of light emitting elements emit light to expose the photosensitive member to the light; and a transfer member configured to transfer a toner image formed on the photosensitive member, wherein the cartridge is movable between a first position for forming the image on the recording medium and a second position retracted more from the transfer member than the first position, with the cartridge being upwardly moved from the first position so as to be moved to the second position, wherein the light emitting member is movable between a third position for exposing the photosensitive member in order to form the image on the recording medium and a fourth position retracted more from the cartridge than the third position, and the light emitting member is linearly moved from the third position to the fourth position, and wherein, when the cartridge is in the second position and the light emitting member is in the fourth position, the cartridge can be removed from an inside of the main body.

2. An image forming apparatus according to claim 1, further comprising a moving member movable with respect to the main body, wherein, when the moving member is in a first predetermined position, the cartridge is in the first position and the light emitting member is in the third position, and when the moving member is moved from the first predetermined position to a second predetermined position, the cartridge is moved to the second position and the light emitting member is moved to the fourth position.

3. An image forming apparatus according to claim 2, wherein the main body is provided with an opening through which the cartridge passes when the cartridge is removed from the inside of the main body, and wherein the moving member is an openable and closable member configured to cover the opening when the openable and closable member is in the first predetermined position and to open the opening for removing the cartridge from the inside of the main body when the openable and closable member is in the second predetermined position.

4. An image forming apparatus according to claim 1, wherein the light emitting member is moved from the third position to the fourth position within the inside of the main body.

5. An image forming apparatus according to claim 1, wherein the cartridge is moved from the first position to the second position within the inside of the main body.

6. An image forming apparatus according to claim 1, wherein the cartridge includes a charging member configured to charge the photosensitive member.

7. An image forming apparatus according to claim 1, wherein the cartridge includes a developing member configured to develop a latent image on the photosensitive member with developer.

8. An image forming apparatus according to claim 1, wherein the cartridge includes a member configured to remove developer from the photosensitive member.

9. An image forming apparatus according to claim 1, wherein the cartridge is at least upwardly moved so as to be moved from the first position to the second position, and the light emitting member is upwardly moved so as to be moved from the third position to the fourth position.

10. An image forming apparatus which forms an image on a recording medium, the image forming apparatus comprising:

a plurality of cartridges each including a photosensitive member and configured to be removed from a main body of the image forming apparatus;

a plurality of light emitting members corresponding to the photosensitive members of the plurality of cartridges and each having a plurality of light emitting elements arranged in a rotation axis direction of a corresponding photosensitive member and configured to make the plurality of light emitting elements emit light to expose the corresponding photosensitive member to the light; and a transfer member configured to transfer a toner image formed on the photosensitive member of each of the plurality of cartridges, wherein each of the plurality of cartridges is movable between a first position for forming the image on the recording medium and a second position retracted more from the transfer member than the first position, with each of the plurality of cartridges being upwardly moved from the first position so as to be moved to the second position, wherein each of the plurality of light emitting members is movable between a third position for exposing the corresponding photosensitive member in order to form the image on the recording medium and a fourth position retracted more from a cartridge of the corresponding photosensitive member than the third position, and each of the plurality of light emitting members is linearly moved from the third position to the fourth position, and wherein, when each of the plurality of cartridges is in the second position and each of the plurality of light emitting members is in the fourth position, the plurality of cartridges can be removed from an inside of the main body.

11. An image forming apparatus according to claim 10, further comprising a moving member movable with respect to the main body, wherein, when the moving member is in a first predetermined position, the plurality of cartridges are in the first position and the plurality of light emitting members are in the third position, and when the moving member is moved from the first predetermined position to a second predetermined position, the plurality of cartridges are moved to the second position and the plurality of light emitting members are moved to the fourth position.

12. An image forming apparatus according to claim 11, wherein the main body is provided with an opening through which the plurality of cartridges pass when the plurality of cartridges are removed from the inside of the main body, and wherein the moving member is an openable and closable member configured to cover the opening when the openable and closable member is in the first predetermined position and to open the opening for removing the plurality of cartridges from the inside of the main body when the openable and closable member is in the second predetermined position.

13. An image forming apparatus according to claim 10, wherein the transfer member is a belt.

14. An image forming apparatus according to claim 13, wherein, when the plurality of cartridges are in the first position, the transfer member is disposed below the photosensitive member of each of the plurality of cartridges.

15. An image forming apparatus which forms an image on a recording medium, the image forming apparatus comprising:

a cartridge including a photosensitive member and configured to be removed from a main body of the image forming apparatus;

a light emitting member having a plurality of light emitting elements arranged in a rotation axis direction of the photosensitive member and configured to make the plurality of light emitting elements emit light to expose the photosensitive member to the light;

a transfer member configured to transfer a toner image formed on the photosensitive member; and a single moving member movable with respect to the main body, wherein, when the single moving member is in a first predetermined position, exposure by the light emitting member and transfer by the transfer member are performed, and wherein, when the single moving member is moved from the predetermined position to a second predetermined position, the light emitting member is linearly moved so that the light emitting member and the photosensitive member are more separated from each other than when the single moving member is in the first predetermined position and the cartridge is upwardly moved so that the photosensitive member and the transfer member are more separated from each other than when the single moving member is in the first predetermined position, so that the cartridge can be removed from an inside of the main body.

16. An image forming apparatus according to claim 15, wherein the main body is provided with an opening through which the cartridge passes when the cartridge is removed from the inside of the main body, and wherein the single moving member is an openable and closable member configured to cover the opening when the openable and closable member is in the first predetermined position and to open the opening for removing the cartridge from the inside of the main body when the openable and closable member is in the second predetermined position.

17. An image forming apparatus according to claim 15, wherein, when the single moving member is in the first predetermined position, the photosensitive member and the transfer member abut against each other and the light emitting member and the photosensitive member abut against each other, and when the single moving member is in the second predetermined position, the photosensitive member and the transfer member are separated from each other and the light emitting member and the photosensitive member are separated from each other.

18. An image forming apparatus according to claim 15, wherein, when the single moving member is in the first predetermined position and when the single moving member is in the second predetermined position, the light emitting member is within the inside of the main body.

19. An image forming apparatus according to claim 15, wherein the cartridge includes a charging member configured to charge the photosensitive member.

20. An image forming apparatus according to claim 15, wherein the cartridge includes a developing member configured to develop a latent image on the photosensitive member with developer.

21. An image forming apparatus according to claim 15, wherein the cartridge includes a member configured to remove developer from the photosensitive member.

22. An image forming apparatus which forms an image on a recording medium, the image forming apparatus comprising:

a plurality of cartridges each including a photosensitive member and configured to be removed from a main body of the image forming apparatus;

a plurality of light emitting members corresponding to the photosensitive members of the plurality of cartridges and each having a plurality of light emitting elements arranged in a rotation axis direction of a corresponding photosensitive member and configured to make the plurality of light emitting elements emit light to expose the corresponding photosensitive member to the light;

a transfer member configured to transfer a toner image formed on the photosensitive member of each of the plurality of cartridges; and a single moving member movable with respect to the main body, wherein, when the single moving member is in a first predetermined position, exposure by the light emitting member and transfer by the transfer member are performed, and wherein, when the single moving member is moved from the first predetermined position to a second predetermined position, each of the plurality of light emitting members is linearly moved so that each of the plurality of light emitting members and the corresponding photosensitive member are more separated from each other than when the single moving member is in the predetermined position and each of the plurality of cartridges is upwardly moved so that the photosensitive member of each of the plurality of cartridges and the transfer member are more separated from each other than when the single moving member is in the predetermined position, so that the plurality of cartridges can be removed from an inside of the main body.

23. An image forming apparatus according to claim 22, wherein the main body is provided with an opening through which the plurality of cartridges pass when the plurality of cartridges are removed from the inside of the main body, and wherein the single moving member is an openable and closable member configured to cover the opening when the openable and closable member is in the first predetermined position and to open the opening for removing the plurality of cartridges from the inside of the main body when the openable and closable member is in the second predetermined position.

24. An image forming apparatus according to claim 22, wherein the transfer member is a belt.

25. An image forming apparatus according to claim 24, wherein, when the single moving member is in the first predetermined position, the transfer member is disposed below the photosensitive member of each of the plurality of cartridges.

26. An image forming apparatus which forms an image on a recording medium, the image forming apparatus comprising:

a cartridge including a photosensitive member and configured to be removed from a main body of the image forming apparatus;

a light emitting member having a plurality of light emitting elements arranged in a rotation axis direction of the photosensitive member and configured to make the plurality of light emitting elements emit light to expose the photosensitive member to the light; and a transfer member configured to transfer a toner image formed on the photosensitive member, wherein the cartridge is movable between a first position for forming the image on the recording medium and a second position retracted more from the transfer member than the first position, with the cartridge in the second position located inside the main body, wherein the light emitting member is movable between a third position for exposing the photosensitive member in order to form the image on the recording medium and a fourth position retracted more from the cartridge than the third position, and the light emitting member is linearly moved from the third position to the fourth position, and wherein, when the cartridge is in the second position and the light emitting member is in the fourth position, the cartridge can be removed from an inside of the main body.

27. An image forming apparatus according to claim 26, further comprising a moving member movable with respect to the main body, wherein, when the moving member is in a first predetermined position, the cartridge is in the first position and the light emitting member is in the third position, and when the moving member is moved from the first predetermined position to a second predetermined position, the cartridge is moved to the second position and the light emitting member is moved to the fourth position.

28. An image forming apparatus according to claim 27, wherein the main body is provided with an opening through which the cartridge passes when the cartridge is removed from the inside of the main body, and wherein the moving member is an openable and closable member configured to cover the opening when the openable and closable member is in the first predetermined position and to open the opening for removing the cartridge from the inside of the main body when the openable and closable member is in the second predetermined position.

29. An image forming apparatus according to claim 26, wherein the light emitting member is moved from the third position to the fourth position within the inside of the main body.

30. An image forming apparatus according to claim 26, wherein the cartridge is moved from the first position to the second position within the inside of the main body.

31. An image forming apparatus according to claim 26, wherein the cartridge includes a charging member configured to charge the photosensitive member.

32. An image forming apparatus according to claim 26, wherein the cartridge includes a developing member configured to develop a latent image on the photosensitive member with developer.

33. An image forming apparatus according to claim 26, wherein the cartridge includes a member configured to remove developer from the photosensitive member.

34. An image forming apparatus according to claim 26, wherein the cartridge is at least upwardly moved so as to be moved from the first position to the second position, and the light emitting member is upwardly moved so as to be moved from the third position to the fourth position.

35. An image forming apparatus which forms an image on a recording medium, the image forming apparatus comprising:

a plurality of cartridges each including a photosensitive member and configured to be removed from a main body of the image forming apparatus;

a plurality of light emitting members corresponding to the photosensitive members of the plurality of cartridges and each having a plurality of light emitting elements arranged in a rotation axis direction of a corresponding photosensitive member and each configured to make the plurality of light emitting elements emit light to expose the corresponding photosensitive member to the light; and a transfer member configured to transfer a toner image formed on the photosensitive member of each of the plurality of cartridges, wherein each of the plurality of cartridges is movable between a first position for forming the image on the recording medium and a second position retracted more from the transfer member than the first position, with each of the plurality of cartridges in the second position located inside the main body, wherein each of the plurality of light emitting members is movable between a third position for exposing the corresponding photosensitive member in order to form the image on the recording medium and a fourth position retracted more from a cartridge of the corresponding photosensitive member than the third position, and each of the plurality of light emitting members is linearly moved from the third position to the fourth position, and wherein, when each of the plurality of cartridges is in the second position and each of the plurality of light emitting members is in the fourth position, the plurality of cartridges can be removed from an inside of the main body.

36. An image forming apparatus according to claim 35, further comprising a moving member movable with respect to the main body, wherein, when the moving member is in a first predetermined position, the plurality of cartridges are in the first position and the plurality of light emitting members are in the third position, and when the moving member is moved from the predetermined position to a second predetermined position, the plurality of cartridges are moved to the second position and the plurality of light emitting members are moved to the fourth position.

37. An image forming apparatus according to claim 36, wherein the main body is provided with an opening through which the plurality of cartridges pass when the plurality of cartridges are removed from the inside of the main body, and wherein the moving member is an openable and closable member configured to cover the opening when the openable and closable member is in the first predetermined position and to open the opening for removing the plurality of cartridges from the inside of the main body when the openable and closable member is in the second predetermined position.

38. An image forming apparatus according to claim 35, wherein the transfer member is a belt.

39. An image forming apparatus according to claim 38, wherein, when the plurality of cartridges are in the first position, the transfer member is disposed below the photosensitive member of each of the plurality of cartridges.

40. An image forming apparatus which forms an image on a recording medium, the image forming apparatus comprising:

a cartridge including a photosensitive member and configured to be removed from a main body of the image forming apparatus;

a light emitting member having a plurality of light emitting elements arranged in a rotation axis direction of the photosensitive member and configured to make the plurality of light emitting elements emit light to expose the photosensitive member to the light;

a transfer member configured to transfer a toner image formed on the photosensitive member; and a single moving member movable with respect to the apparatus main body, wherein, when the single moving member is in a first predetermined position, exposure by the light emitting member and transfer by the transfer member are performed, and wherein, when the single moving member is moved from the first predetermined position to a second predetermined position, the light emitting member is linearly moved so that the light emitting member and the photosensitive member are more separated from each other than when the single moving member is in the first predetermined position and the photosensitive member and the transfer member are more separated from each other in a state in which the cartridge is located inside the main body than when the single moving member is in the first predetermined position, so that the cartridge can be removed from an inside of the main body.

41. An image forming apparatus according to claim 40, wherein the main body is provided with an opening through which the cartridge passes when the cartridge is removed from the inside of the main body, and wherein the single moving member is an openable and closable member configured to cover the opening when the openable and closable member is in the first predetermined position and to open the opening for removing the cartridge from the inside of the main body when the openable and closable member is in the second predetermined position.

42. An image forming apparatus according to claim 40, wherein, when the single moving member is in the first predetermined position, the photosensitive member and the transfer member abut against each other and the light emitting member and the photosensitive member abut against each other, and when the single moving member is in the second predetermined position, the photosensitive member and the transfer member are separated from each other and the light emitting member and the photosensitive member are separated from each other.

43. An image forming apparatus according to claim 40, wherein, when the single moving member is in the first predetermined position and when the single moving member is in the second predetermined position, the light emitting member is within the inside of the main body.

44. An image forming apparatus according to claim 40, wherein the cartridge includes a charging member configured to charge the photosensitive member.

45. An image forming apparatus according to claim 40, wherein the cartridge includes a developing member configured to develop a latent image on the photosensitive member with developer.

46. An image forming apparatus according to claim 40, wherein the cartridge includes a member configured to remove developer from the photosensitive member.

47. An image forming apparatus which forms an image on a recording medium, the image forming apparatus comprising:

a plurality of cartridges each including a photosensitive member and configured to be removed from a main body of the image forming apparatus;

a plurality of light emitting members corresponding to the photosensitive members of the plurality of cartridges and each having a plurality of light emitting elements arranged in a rotation axis direction of a corresponding photosensitive member and configured to make the plurality of light emitting elements emit light to expose the corresponding photosensitive member to the light;

a transfer member configured to transfer a toner image formed on the photosensitive member of each of the plurality of cartridges; and a single moving member movable with respect to the main body, wherein, when the single moving member is in a first predetermined position, exposure by the light emitting member and transfer by the transfer member are performed, and wherein, when the single moving member is moved from the first predetermined position to a second predetermined position, each of the plurality of light emitting members is linearly moved so that each of the plurality of light emitting members and the corresponding photosensitive member are more separated from each other than when the single moving member is in the first predetermined position and the photosensitive member of each of the plurality of cartridges and the transfer member are more separated from each other in a state in which each of the plurality of cartridges is located inside the main body than when the single moving member is in the first predetermined position, so that the plurality of cartridges can be removed from an inside of the main body.

48. An image forming apparatus according to claim 47, wherein the main body is provided with an opening through which the plurality of cartridges pass when the plurality of cartridges are removed from the inside of the main body, and wherein the single moving member is an openable and closable member configured to cover the opening when the openable and closable member is in the first predetermined position and to open the opening for removing the plurality of cartridges from the inside of the apparatus main body when the openable and closable member is in the second predetermined position.

49. An image forming apparatus according to claim 47, wherein the transfer member is a belt.

50. An image forming apparatus according to claim 49, wherein, when the single moving member is in the first predetermined position, the transfer member is disposed below the photosensitive member of each of the plurality of cartridges.

51. An image forming apparatus according to claim 1, wherein the plurality of light emitting elements comprise a plurality of light emitting diodes.

52. An image forming apparatus according to claim 10, wherein the plurality of light emitting elements comprise a plurality of light emitting diodes.

53. An image forming apparatus according to claim 15, wherein the plurality of light emitting elements comprise a plurality of light emitting diodes.

54. An image forming apparatus according to claim 22, wherein the plurality of light emitting elements comprise a plurality of light emitting diodes.

55. An image forming apparatus according to claim 26, wherein the plurality of light emitting elements comprise a plurality of light emitting diodes.

56. An image forming apparatus according to claim 35, wherein the plurality of light emitting elements comprise a plurality of light emitting diodes.

57. An image forming apparatus according to claim 40, wherein the plurality of light emitting elements comprise a plurality of light emitting diodes.

58. An image forming apparatus according to claim 47, wherein the plurality of light emitting elements comprise a plurality of light emitting diodes.

* * * * *